US011471916B2

(12) United States Patent
Kumar et al.

(10) Patent No.: US 11,471,916 B2
(45) **Date of Patent: *Oct. 18, 2022**

(54) METAL SORTER

(71) Applicant: Sortera Alloys, Inc., Fort Worth, TX (US)

(72) Inventors: Nalin Kumar, Fort Worth, TX (US); Manuel Gerardo Garcia, Jr., Lexington, KY (US); Isha Kamleshbhai Maun, Arlington, TX (US)

(73) Assignee: SORTERA ALLOYS, INC., Fort Wayne, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/939,011

(22) Filed: Jul. 26, 2020

(65) Prior Publication Data

US 2020/0368786 A1 Nov. 26, 2020

Related U.S. Application Data

(63) Continuation of application No. 16/375,675, filed on Apr. 4, 2019, now Pat. No. 10,722,922, which is a (Continued)

(51) Int. Cl.
*B07C 5/342* (2006.01)
*B07C 5/34* (2006.01)
*B07C 5/04* (2006.01)

(52) U.S. Cl.
CPC ..... *B07C 5/3422* (2013.01); *B07C 5/34* (2013.01); *B07C 5/342* (2013.01); *B07C 5/04* (2013.01); *B07C 2501/0054* (2013.01)

(58) Field of Classification Search
CPC .... B07C 5/04; B07C 5/10; B07C 5/34; B07C 5/3422; B07C 5/346; B07C 5/3416; B07C 2501/0054
See application file for complete search history.

(56) References Cited

U.S. PATENT DOCUMENTS 2,194,381 A 9/1937 Cadman
2,417,878 A 2/1944 Luzietti et al.
(Continued)

FOREIGN PATENT DOCUMENTS

CA 2893877 12/2015
CN 200953004 9/2007
(Continued)

OTHER PUBLICATIONS

International Alloy Designations and Chemical Composition Limits for Wrought Aluminum and Wrought Aluminum Alloys, The Aluminum Association, Inc., revised Jan. 2015, 38 pages.
(Continued)

*Primary Examiner* — Michael McCullough
*Assistant Examiner* — Kalyanavenkateshware Kumar
(74) *Attorney, Agent, or Firm* — Kelly Kordzik

(57) ABSTRACT

A material sorting system sorts materials utilizing a vision system that implements a machine learning system in order to identify or classify each of the materials, which are then sorted into separate groups based on such an identification or classification determining that the materials are composed of either wrought aluminum, extruded aluminum, or cast aluminum.

18 Claims, 15 Drawing Sheets

Related U.S. Application Data continuation-in-part of application No. 15/963,755, filed on Apr. 26, 2018, now Pat. No. 10,710,119, which is a continuation-in-part of application No. 15/213,129, filed on Jul. 18, 2016, now Pat. No. 10,207,296.

(60) Provisional application No. 62/490,219, filed on Apr. 26, 2017, provisional application No. 62/193,332, filed on Jul. 16, 2015.

(56) References Cited

U.S. PATENT DOCUMENTS

| | | | |
|---|---|---|---|
| 2,942,792 | A | 7/1957 | Anderson et al. |
| 2,953,554 | A | 9/1960 | Miller et al. |
| 3,512,638 | A | 5/1970 | Chengges et al. |
| 3,662,874 | A | 5/1972 | Muller |
| 3,791,518 | A | 2/1974 | Vanderhoof |
| 3,955,678 | A | 5/1976 | Moyer |
| 3,973,736 | A | 8/1976 | Nilsson |
| 3,974,909 | A | 8/1976 | Johnson |
| 4,004,681 | A | 1/1977 | Clewett et al. |
| 4,031,998 | A | 6/1977 | Suzuki et al. |
| 4,044,897 | A | 8/1977 | Maxted |
| 4,253,154 | A | 2/1981 | Russ et al. |
| 4,317,521 | A | 3/1982 | Clark et al. |
| 4,413,721 | A | 11/1983 | Bollier |
| 4,488,610 | A | 12/1984 | Yankloski |
| 4,572,735 | A | 2/1986 | Poetzschke et al. |
| 4,586,613 | A | 5/1986 | Horii |
| 4,726,464 | A | 2/1988 | Canziani |
| 4,834,870 | A | 5/1989 | Osterberg et al. |
| 4,848,590 | A | 7/1989 | Kelly |
| 5,054,601 | A | 10/1991 | Sjogren et al. |
| 5,114,230 | A | 5/1992 | Pryor |
| 5,236,092 | A | 8/1993 | Krotkov et al. |
| 5,260,576 | A | 11/1993 | Sommer, Jr. et al. |
| 5,410,637 | A | 4/1995 | Kern et al. |
| 5,433,311 | A | 7/1995 | Bonnet |
| 5,462,172 | A | 10/1995 | Kumagai et al. |
| 5,570,773 | A | 11/1996 | Bonnet |
| 5,663,997 | A | 9/1997 | Willis et al. |
| 5,676,256 | A | 10/1997 | Kumar et al. |
| 5,733,592 | A | 3/1998 | Wettstein et al. |
| 5,738,224 | A | 4/1998 | Sommer, Jr. et al. |
| 5,836,436 | A | 11/1998 | Fortenbery et al. |
| 5,911,327 | A | 6/1999 | Tanaka et al. |
| 6,076,653 | A | 6/2000 | Bonnet |
| 6,100,487 | A | 8/2000 | Schultz et al. |
| 6,148,990 | A | 11/2000 | Lapeyre et al. |
| 6,266,390 | B1 | 7/2001 | Sommer, Jr. et al. |
| 6,273,268 | B1 | 8/2001 | Axmann |
| 6,313,422 | B1 | 11/2001 | Anibas |
| 6,313,423 | B1 * | 11/2001 | Sommer ..... B07C 5/366 209/579 |
| 6,412,642 | B2 | 7/2002 | Charles et al. |
| 6,457,859 | B1 | 10/2002 | Lu et al. |
| 6,519,315 | B2 | 2/2003 | Sommer, Jr. et al. |
| 6,795,179 | B2 | 9/2004 | Kumar |
| 6,888,917 | B2 | 5/2005 | Sommer, Jr. et al. |
| 6,983,035 | B2 | 1/2006 | Price et al. |
| 7,073,651 | B2 | 7/2006 | Costanzo et al. |
| 7,099,433 | B2 | 8/2006 | Sommer et al. |
| 7,200,200 | B2 | 4/2007 | Laurila et al. |
| 7,341,154 | B2 | 3/2008 | Boer |
| 7,564,943 | B2 | 7/2009 | Sommer, Jr. et al. |
| 7,616,733 | B2 | 11/2009 | Sommer et al. |
| 7,674,994 | B1 | 3/2010 | Valerio |
| 7,763,820 | B1 | 7/2010 | Sommer, Jr. et al. |
| 7,848,484 | B2 | 12/2010 | Sommer, Jr. et al. |
| 7,886,915 | B2 | 2/2011 | Shulman |
| 7,903,789 | B2 | 3/2011 | Morton et al. |
| 7,978,814 | B2 | 7/2011 | Sommer et al. |
| 7,991,109 | B2 | 8/2011 | Golenhofen |
| 8,073,099 | B2 | 12/2011 | Niu et al. |
| 8,144,831 | B2 | 3/2012 | Sommer, Jr. et al. |
| 8,172,069 | B2 | 5/2012 | Prakasam |
| 8,429,103 | B1 | 4/2013 | Aradhye et al. |
| 8,433,121 | B2 | 4/2013 | Kosarev |
| 8,476,545 | B2 | 7/2013 | Sommer et al. |
| 8,553,838 | B2 | 10/2013 | Sommer et al. |
| 8,567,587 | B2 | 10/2013 | Faist et al. |
| 8,576,988 | B2 | 11/2013 | Lewalter et al. |
| 8,654,919 | B2 | 2/2014 | Sabol et al. |
| 8,855,809 | B2 | 10/2014 | Spencer et al. |
| 8,903,040 | B2 | 12/2014 | Maeyama et al. |
| 9,316,596 | B2 | 4/2016 | Levesque |
| 9,785,851 | B1 | 10/2017 | Torek et al. |
| 2003/0038064 | A1 | 2/2003 | Harbeck et al. |
| 2003/0147494 | A1 | 8/2003 | Sommer, Jr. et al. |
| 2004/0151364 | A1 | 8/2004 | Kenneway et al. |
| 2006/0239401 | A1 | 10/2006 | Sommer, Jr. et al. |
| 2008/0029445 | A1 | 2/2008 | Russcher et al. |
| 2008/0041501 | A1 * | 2/2008 | Platek ..... C22C 21/06 148/551 |
| 2008/0092922 | A1 | 4/2008 | Dick |
| 2008/0257795 | A1 | 10/2008 | Shuttleworth |
| 2010/0017020 | A1 | 1/2010 | Hubbard-Nelson et al. |
| 2010/0195795 | A1 | 8/2010 | Golenhofen |
| 2010/0264070 | A1 | 10/2010 | Sommer, Jr. et al. |
| 2010/0282646 | A1 | 11/2010 | Looy et al. |
| 2011/0083871 | A1 | 4/2011 | Lalancette et al. |
| 2011/0247730 | A1 * | 10/2011 | Yanar ..... C22F 1/057 148/550 |
| 2012/0148018 | A1 | 6/2012 | Sommer, Jr. et al. |
| 2012/0288058 | A1 | 11/2012 | Maeyama et al. |
| 2013/0028487 | A1 * | 1/2013 | Stager ..... B07C 5/342 382/110 |
| 2013/0079918 | A1 | 3/2013 | Spencer et al. |
| 2013/0092609 | A1 | 4/2013 | Andersen |
| 2013/0126399 | A1 | 5/2013 | Wolff et al. |
| 2013/0229510 | A1 | 9/2013 | Killmann |
| 2013/0264249 | A1 | 10/2013 | Sommer, Jr. et al. |
| 2013/0304254 | A1 | 11/2013 | Torek et al. |
| 2015/0092922 | A1 | 4/2015 | Liu et al. |
| 2015/0170024 | A1 | 6/2015 | Chatterjee et al. |
| 2016/0299091 | A1 | 10/2016 | Bamber et al. |
| 2017/0014868 | A1 | 1/2017 | Kumar et al. |

FOREIGN PATENT DOCUMENTS

| | | | |
|---|---|---|---|
| CN | 201440132 | | 4/2010 |
| CN | 201464390 | | 5/2010 |
| CN | 101776620 | A | 7/2010 |
| CN | 201552461 | | 7/2010 |
| CN | 103745901 | | 4/2014 |
| CN | 101776620 | B | 6/2014 |
| CN | 103955707 | | 7/2014 |
| CN | 203688493 | | 7/2014 |
| CN | 204359695 | | 5/2015 |
| CN | 204495749 | | 7/2015 |
| CN | 204537711 | | 8/2015 |
| CN | 204575572 | | 8/2015 |
| DE | 202009006383 | | 9/2009 |
| EP | 0011892 | | 11/1983 |
| EP | 0074447 | | 1/1987 |
| EP | 0433828 | A2 | 12/1990 |
| EP | 0351778 | B1 | 10/1993 |
| EP | 2243089 | A1 | 10/2010 |
| JP | 5083196 | | 11/2012 |
| RU | 2004101401 | | 2/2005 |
| RU | 2006136756 | | 4/2008 |
| RU | 2339974 | | 11/2008 |
| RU | 2361194 | | 7/2009 |
| WO | WO2001/022072 | | 3/2001 |
| WO | WO2009/039284 | | 3/2009 |
| WO | WO2011/159269 | | 12/2011 |
| WO | WO2012/094568 | A2 | 7/2012 |
| WO | WO2013/033572 | | 3/2013 |
| WO | WO2013/180922 | | 12/2013 |
| WO | WO2015/195988 | | 12/2015 |
| WO | WO2016/199074 | | 12/2016 |

(56) References Cited

FOREIGN PATENT DOCUMENTS

| | | |
|---|---|---|
| WO | WO2017/001438 | 1/2017 |
| WO | WO 2017/221246 | 12/2017 |

OTHER PUBLICATIONS

International Searching Authority, International Search Report and the Written Opinion, International Application No. PCT/US2016/042850, dated Sep. 28, 2016.
R. Sitko et al., "Quantification in X-Ray Fluorescence Spectrometry," X-Ray Spectroscopy, Dr. Shatendra K Sharma (Ed.), ISBN: 978-953-307-967-7, InTech, 2012, pp. 137-163; Available from: http://www.intechopen.com/books/x-ray-spectroscopy/quantification-in-x-ray-fluorescence-spectrometry, Feb. 1, 2012.
Scrap Specifications Circular, Institute of Scrap Recycling Industries, Inc., effective Jan. 21, 2016, 58 pages.
The International Bureau of WIPO, International Preliminary Report on Patentability, International Application No. PCT/US2016/42850, dated Jan. 25, 2018.
A. Lee, "Comparing Deep Neural Networks and Traditional Vision Algorithms in Mobile Robotics," Swarthmore College, 9 pages, downloaded from Internet on May 1, 2018.
C. K. Lowe et al., "Data Mining With Different Types of X-Ray Data," JCPDS-International Centre for Diffraction Data 2006, ISSN 1097-0002, pp. 315-321.
M. Razzak et al., "Deep Learning for Medical Image Processing: Overview, Challenges and Future," 30 pages, downloaded from Internet on May 1, 2018.
J. Schmidhuber et al., "Deep Learning in Neural Networks: An Overview," The Swiss AI Lab IDSIA, Technical Report IDSIA-03-14/arXiv:1404.7828 v4 [cs.NE], Oct. 8, 2014, 88 pages.
M. Singh et al., "Transforming Sensor Data to the Image Domain for Deep Learning—an Application to Footstep Detection," International Joint Conference on Neural Networks, Anchorage, Alaska, 8 pages, May 14-19, 2017.
K. Tarbell et al., "Applying Machine Learning to the Sorting of Recyclable Containers," University of Illinois at Urbana-Champaign, Urbana, Illinois, 7 pages, downloaded from Internet on May 1, 2018.
Wikipedia, Convolutional neural network, 18 pages https://en.wikipedia.org/w/index.php?title=Convolutional_neural_network, downloaded from Internet on May 1, 2018.
Wikipedia, TensorFlow, 4 pages https://en.wikipedia.org/w/index.php?title=TensorFlow&oldid=835761390, downloaded from Internet on May 1, 2018.
The United States Patent and Trademark Office, Non-Final Office Action, U.S. Appl. No. 15/213,129, dated Oct. 6, 2017.
International Searching Authority, International Search Report and the Written Opinion, International Application No. PCT/US2018/029640, dated Jul. 23, 2018.
European Patent Office; Extended Search Report for 16825313.6; dated Jan. 28, 2019; 12 pages; Munich, DE.
The United States Patent and Trademark Office, Non-Final Office Action, U.S. Appl. No. 16/375,675, filed Jun. 28, 2019.
The United States Patent and Trademark Office, Final Office Action, U.S. Appl. No. 16/375,675, filed Jan. 17, 2020.
"Alloy Data: Aluminum Die Casting Alloys," MES, Inc., 4 pages, downloaded from the Internet Mar. 28, 2019, www.mesinc.com.
C.O. Augustin et al., "Removal of Magnesium from Aluminum Scrap and Aluminum-Magnesium Alloys," Bulletin of Electrochemistry 2(6), Nov.-Dec. 1986, pp. 619-620.
E.A. Vieira et al., "Use of Chlorine to Remove Magnesium from Molten Aluminum," Materials Transactions, vol. 53, No. 3, pp. 477-482, Feb. 25, 2012.
India Patent Office; Office Action issued for corresponding India Application Serial No. 201937044046; dated Jun. 4, 2020; 7 pages; IN.
European Patent Office; Extended European Search Report for corresponding EP 19792330.3; dated Apr. 30, 2021; 7 pages; Munich, DE.
India Patent Office; Office Action issued for corresponding India Application Serial No. 201817002365; dated Mar. 12, 2020; 6 pages; IN.
International Searching Authority, International Search Report and the Written Opinion, International Application No. PCT/US2019/022995, dated Jun. 5, 2019; 10 pages; Alexandria, VA; US.
T. Miller et al., "Elemental Imaging for Pharmaceutical Tablet Formulations Analysis By Micro X-ray Fluorescence," International Centre for Diffraction Data, 2005, Advances in X-ray Analysis, vol. 48, pp. 274-283.
T. Moriyama, "Pharmaceutical Analysis (5), Analysis of trace impurities in pharmaceutical products using polarized EDXRF spectrometer NEX CG," Rigaku Journal, vol. 29, No. 2, 2013, pp. 19-21.
U.S. Appl. No. 15/213,129, filed Jul. 18, 2016.
M. Baudelet et al., "The first years of laser-induced breakdown spectroscopy," J. Anal. At. Spectrom., Mar. 27, 2013, 6 pages.
P. R. Schwoebel et al., "Studies of a prototype linear stationary x-ray source for tomosynthesis imaging," Phys. Med Biol. 59, pp. 2393-2413, Apr. 17, 2014.
International Searching Authority, International Search Report and the Written Opinion of The International Searching Authority, International Application No. PCT/US2016/45349, dated Oct. 17, 2016.
J. McComb et al., "Rapid screening of heavy metals and trace elements in environmental samples using portable X-ray fluorescence spectrometer, A comparative study," Water Air Soil Pollut., Dec. 2014, 225(12): doi:10.1007/s11270-014-2169-5.
J. Mondia, "Using X-ray fluoresence to measure inorganics in biopharmaceutical raw materials," Anal. Methods, Mar. 18, 2015, vol. 7, pp. 3545-3550.
L. Goncalves, "Assesment of metal elements in final drug products by wavelength dispersive X-ray fluorescence spectrometry," Anal. Methods, May 19, 2011, vol. 3, pp. 1468-1470.
L. Hutton, "Electrochemical X-ray Fluorescence Spectroscopy for Trace Heavy Metal Analysis: Enhancing X-ray Fluorescence Detection Capabilities by Four Orders of Magnitude," Analytical Chemistry, Apr. 4, 2014, vol. 86, pp. 4566-4572.
L. Moens et al., Chapter 4, X-Ray Fluorescence, Modern Analytical Methods in Art and Archaeology, Chemical Analysis Series, vol. 155, pp. 55-79, copyright 2000.
H. Rebiere et al., "Contribution of X-Ray Fluorescence Spectrometry for the Analysis of Falsified Products," ANSM, The French National Agency for Medicines and Health Products Safety, Laboratory Controls Division, France, 1 page, Mar. 2017.
B. Shaw, "Applicability of total reflection X-ray fluorescence (TXRF) as a screening platform for pharmaceutical inorganic impurity analysis," Journal of Pharmaceutical and Biomedical Analysis, vol. 63, 2012, pp. 151-159.
Briefing Elemental Impurities-Limits, Revision Bulletin, The United States Pharmacopeial Convention, Feb. 1, 2013, 3 pp.
Chapter 6, Functional Description, S2 Picofox User Manual, 2008, pp. 45-64.
D. Bradley, "Pharmaceutical toxicity: AAS and other techniques measure pharma heavy metal," Ezine, May 15, 2011, 2 pages.
E. Margui et al., "Determination of metal residues in active pharmaceutical ingredients according to European current legislation by using X-ray fluorescence spectrometry," J. Anal. At. Spectrom., Jun. 16, 2009, vol. 24, pp. 1253-1257.
Elemental Impurity Analysis in Regulated Pharmaceutical Laboratories, A Primer, Agilent Technologies, Jul. 3, 2012, 43 pages.
Exova, X-ray fluorescence: a new dimension to elemental analysis, downloaded from www.exova.com on Jul. 26, 2016, 3 pages.
G. O'Neil, "Direct Identification and Analysis of Heavy Metals in Solution (Hg, Cu, Pb, Zn, Ni) by Use of in Situ Electrochemical X-ray Fluorescence," Analytical Chemistry, Feb. 2015, 22 pages.
Guideline for Elemental Impurities, Q3D, International Conference on Harmonisation of Technical Requirements for Registration of Pharmaceuticals for Human Use, ICH Harmonised Guideline, Current Step 4 version, Dec. 16, 2014, 77 pages.

(56) References Cited

OTHER PUBLICATIONS

Skpecim Spectral Imaging; Hyperspectral Technology vs. RGB; at least as early as Mar. 9, 2021; 3 pages; Oulu, Finland.

* cited by examiner

| Alloy | End Product | Si | Mg | Fe | Mn | Cu | Zn | Al |
|---|---|---|---|---|---|---|---|---|
| | | % | % | % | % | % | % | % |
| 3105 | Home Siding | 0.6 | 0.2–0.8 | 0.7 | 0.3–0.8 | 0.3 | 0.4 | Remaining % |
| 5052 | Sheet Metal | 0.25 | 2.2–2.8 | 0.4 | 0.1 | 0.1 | 0.1 | Remaining % |
| 5083 | Sheet Metal | 0.4 | 4.0–4.9 | 0.4 | 0.4–1.0 | 0.1 | 0.25 | Remaining % |
| 6061 | Extrusions | 0.4–0.8 | 0.8–1.2 | 0.7 | 0.15 | 0.15–0.4 | 0.25 | Remaining % |
| 380 | Cast Engines | 7.5–9.5 | 0.1 | 1.3–2.0 | 0.5 | 3.0–4.0 | 3.0 | Remaining % |

FIG. 3

| Melt Test Results | Si | Mg | Fe | Mn | Cu | Zn | Al |
|---|---|---|---|---|---|---|---|
| | % | % | % | % | % | % | % |
| Twitch | 5.2 | 3.05 | 0.46 | 0.26 | 1.48 | 0.78 | Remaining % |

FIG. 4

| Composition Test Results | Si | Mg | Fe | Mn | Cu | Zn | Al |
|---|---|---|---|---|---|---|---|
| | % | % | % | % | % | % | % |
| Wrought-Sample 1 | 0.66 | 0.65 | 0.4 | 0.17 | 0.16 | 0.11 | Remaining % |
| Wrought-Sample 2 | 0.47 | 0.75 | 0.49 | 0.31 | 0.16 | 0.14 | Remaining % |
| Wrought-Average | 0.56 | 0.7 | 0.45 | 0.24 | 0.16 | 0.12 | Remaining % |

FIG. 6

| Composition Test Results | Si | Mg | Fe | Mn | Cu | Zn | Al |
|---|---|---|---|---|---|---|---|
| | % | % | % | % | % | % | % |
| Cast Fraction | 7.8 | 0.08 | 1.06 | 0.26 | 2.48 | 0.93 | Remaining % |

FIG. 5

METAL SORTER

This application is a continuation of U.S. patent application Ser. No. 16/375,675 (issued as U.S. Pat. No. 10,722,922), which is a continuation-in-part of U.S. patent application Ser. No. 15/963,755 (issued as U.S. Pat. No. 10,710,119), which claims priority to U.S. Provisional Application Ser. No. 62/490,219, and which is a continuation-in-part of U.S. patent application Ser. No. 15/213,129 (issued as U.S. Pat. No. 10,207,296), which claims priority to U.S. Provisional Patent Application Ser. No. 62/193,332, which are all hereby incorporated by reference herein.

GOVERNMENT LICENSE RIGHTS

This disclosure was made with U.S. government support under Grant No. DE-AR0000422 awarded by the U.S. Department of Energy. The U.S. government may have certain rights in this disclosure.

TECHNOLOGY FIELD

The present disclosure relates in general to the sorting of metals, and in particular, to the sorting between aluminum cast materials, extruded aluminum materials, and aluminum wrought materials.

BACKGROUND INFORMATION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Recycling is the process of collecting and processing materials that would otherwise be thrown away as trash, and turning them into new products. Recycling has benefits for communities and for the environment, since it reduces the amount of waste sent to landfills and incinerators, conserves natural resources, increases economic security by tapping a domestic source of materials, prevents pollution by reducing the need to collect new raw materials, and saves energy. After collection, recyclables are generally sent to a material recovery facility to be sorted, cleaned, and processed into materials that can be used in manufacturing.

The recycling of aluminum (Al) scrap is a very attractive proposition in that up to 95% of the energy costs associated with manufacturing can be saved when compared with the laborious extraction of the more costly primary aluminum. Primary aluminum is defined as aluminum originating from aluminum-enriched ore, such as bauxite. At the same time, the demand for aluminum is steadily increasing in markets, such as car manufacturing, because of its lightweight properties. As a result, there are certain economies available to the aluminum industry by developing a well-planned yet simple recycling plan or system. The use of recycled material would be a less expensive metal resource than a primary source of aluminum. As the amount of aluminum sold to the automotive industry (and other industries) increases, it will become increasingly necessary to use recycled aluminum to supplement the availability of primary aluminum.

Correspondingly, it is particularly desirable to efficiently separate aluminum scrap metals into alloy families, since mixed aluminum scrap of the same alloy family is worth much more than that of indiscriminately mixed alloys. For example, in the blending methods used to recycle aluminum, any quantity of scrap composed of similar, or the same, alloys and of consistent quality, has more value than scrap consisting of mixed aluminum alloys. Within such aluminum alloys, aluminum will always be the bulk of the material. However, constituents such as copper, magnesium, silicon, iron, chromium, zinc, manganese, and other alloy elements provide a range of properties to alloyed aluminum and provide a means to distinguish one aluminum alloy from the other.

The Aluminum Association is the authority that defines the allowable limits for aluminum alloy chemical composition. The data for the aluminum wrought alloy chemical compositions is published by the Aluminum Association in "International Alloy Designations and Chemical Composition Limits for Wrought Aluminum and Wrought Aluminum Alloys," which was updated in January 2015, and which is incorporated by reference herein. In general, according to the Aluminum Association, the 1xxx series of wrought aluminum alloys is composed essentially of pure aluminum with a minimum 99% aluminum content by weight; the 2xxx series is wrought aluminum principally alloyed with copper (Cu); the 3xxx series is wrought aluminum principally alloyed with manganese (Mn); the 4xxx series is wrought aluminum alloyed with silicon (Si); the 5xxx series is wrought aluminum primarily alloyed with magnesium (Mg); the 6xxx series is wrought aluminum principally alloyed with magnesium and silicon; the 7xxx series is wrought aluminum primarily alloyed with zinc (Zn); and the 8xxx series is a miscellaneous category.

The Aluminum Association also has a similar document for cast alloys. The 1xx series of cast aluminum alloys is composed essentially of pure aluminum with a minimum 99% aluminum content by weight; the 2xx series is cast aluminum principally alloyed with copper; the 3xx series is cast aluminum principally alloyed with silicon plus copper and/or magnesium; the 4xx series is cast aluminum principally alloyed with silicon; the 5xx series is cast aluminum principally alloyed with magnesium; the 6xx series is an unused series; the 7xx series is cast aluminum principally alloyed with zinc; the 8xx series is cast aluminum principally alloyed with tin; and the 9xx series is cast aluminum alloyed with other elements. Examples of cast alloys utilized for automotive parts include 380, 384, 356, 360, and 319. For example, recycled cast alloys 380 and 384 can be used to manufacture vehicle engine blocks, transmission cases, etc. Recycled cast alloy 356 can be used to manufacture aluminum alloy wheels. And, recycled cast alloy 319 can be used to manufacture transmission blocks.

Generally speaking, wrought aluminum alloys have a higher magnesium concentration than cast aluminum alloys, and cast aluminum alloys have a higher silicon concentration than wrought aluminum alloys.

Furthermore, the presence of commingled pieces of different alloys in a body of scrap limits the ability of the scrap to be usefully recycled, unless the different alloys (or, at least, alloys belonging to different compositional families such as those designated by the Aluminum Association) can be separated prior to re-melting. This is because, when commingled scrap of plural different alloy compositions or composition families is re-melted, the resultant molten mixture contains proportions of the principle alloy and elements (or the different compositions) that are too high to satisfy the compositional limitations required in any particular commercial alloy.

Moreover, as evidenced by the production and sale of the Ford F-150 pickup having a considerable increase in its body and frame parts composed of aluminum instead of steel, it is additionally desirable to recycle sheet metal scrap (e.g., wrought aluminum of certain alloy compositions), including that generated in the manufacture of automotive components from sheet aluminum. Recycling of the scrap involves re-melting the scrap to provide a body of molten metal that can be cast and/or rolled into useful aluminum parts for further production of such vehicles. However, automotive manufacturing scrap (and metal scrap from other sources such as airplanes and commercial and household appliances) often includes a mixture of scrap pieces of wrought and cast pieces and/or two or more aluminum alloys differing substantially from each other in composition. Thus, those skilled in the aluminum alloy art will appreciate the difficulties of separating aluminum alloys, especially alloys that have been worked, such as cast, forged, extruded, rolled, and generally wrought alloys, into a reusable or recyclable worked product.

Two examples of aluminum alloys used in automotive manufacturing are 5052 and 6061 series alloys; their respective chemical compositions are shown in FIG. 3. Four examples of cast aluminum alloys include 319, 383, 380, and 360; the chemical composition of cast alloy 380 is shown in FIG. 3, while the compositions of the others are well-known and publicly available. Because wrought and cast aluminum alloys differ by chemical composition, a supposedly desired method for sorting these alloys at a high throughput rate would be with a technology that directly measures chemical composition for each piece. However, there are no cost-effective methods to sort aluminum alloys into cast and wrought with direct chemical composition measurement in a cost-effective fashion that makes the process profitable.

While it would therefore be beneficial to be able to sort a mass or body of aluminum scrap containing a heterogeneous mixture of pieces of different alloys, to separate the different alloy compositions or at least different alloy families before re-melting for recycling, scrap pieces of different aluminum alloy compositions are not ordinarily visually distinguishable from each other. Optically indistinguishable metals (especially alloys of the same metal) are difficult to sort. For example, it is possible but not easy to manually separate and identify small pieces of cast from wrought aluminum or to spot zinc or steel attachments encapsulated in aluminum. There also is the problem that color sorting is nearly impossible for identically colored materials, such as the all-gray metals of aluminum alloys, zinc, and lead.

Currently, the only existing technology which separates cast from wrought in a cost-effective fashion is an x-ray transmission technology. Because cast is heavier than wrought due to the higher silicon concentration, the cast alloys are denser than the wrought alloys. The x-ray transmission technology is able to measure the heavier density cast aluminum alloys and then sort the cast from the wrought alloys.

However, this method is not perfect. For example, cast alloys 319 and 383 have a relatively high zinc concentration (e.g., ~3%), giving these cast alloys their higher respective density. Cast alloy 360 however, has a lower relative zinc concentration (e.g., ~0.5%), and therefore lower density. The lower density of cast alloy 360 causes the x-ray transmission method to classify this alloy as a wrought alloy and not a cast alloy. Therefore, the x-ray transmission technology does not classify all of the cast alloys correctly due to the large variance in their respective densities. Thus, such cast alloys end up being sorted along with the wrought aluminum alloys, which will result in too much relative silicon in the melted mixture.

BRIEF DESCRIPTION OF THE DRAWINGS

FIG. 3 illustrates a table listing chemical composition limits for common aluminum alloys used for various end products.

FIG. 4 illustrates a table listing data obtained from a melt test of a batch of Twitch.

FIG. 5 illustrates a table listing an exemplary composition obtained from a clean cast fraction.

FIG. 6 illustrates a table listing percentages of metals in a composition obtained from a melt test of wrought scrap pieces sorted from Twitch in accordance with embodiments of the present disclosure.

DETAILED DESCRIPTION

Figure 1:
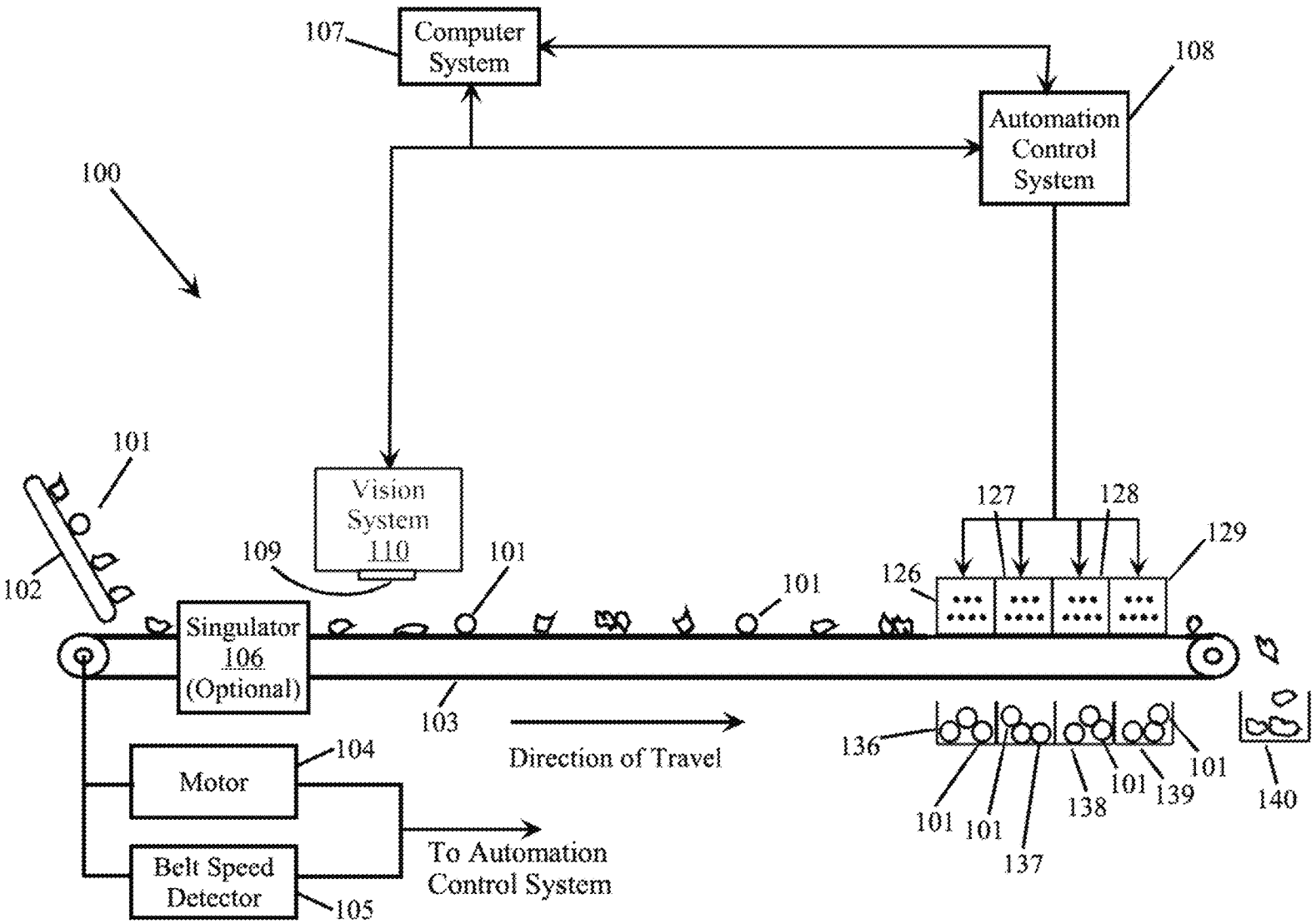
FIG. 1 illustrates a schematic of a sorting system configured in accordance with embodiments of the present disclosure.

Various detailed embodiments of the present disclosure are disclosed herein. However, it is to be understood that the disclosed embodiments are merely exemplary of the disclosure, which may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to employ various embodiments of the present disclosure.

As used herein, a "material" may include a chemical element, a compound or mixture of chemical elements, or a compound or mixture of a compound or mixture of chemical elements, wherein the complexity of a compound or mixture may range from being simple to complex. As used herein, "element" means a chemical element of the periodic table of elements, including elements that may be discovered after the filing date of this application. Classes of materials may include metals (ferrous and nonferrous), metal alloys, plastics (including, but not limited to PCB, HDPE, UHMWPE, and various colored plastics), rubber, foam, glass (including, but not limited to borosilicate or soda lime glass, and various colored glass), ceramics, paper, cardboard, Teflon, PE, bundled wires, insulation covered wires, rare earth elements, etc. As used herein, the term "aluminum" refers to aluminum metal and aluminum-based alloys, viz., alloys containing more than 50% by weight aluminum (including those classified by the Aluminum Association). As used herein, the terms "scrap" and "scrap pieces" refer to material pieces in a solid state as distinguished from a molten or liquid state. Within this disclosure, the terms "scrap," "scrap pieces," "materials," and "material pieces" may be used interchangeably.

As defined within the Guidelines for Nonferrous Scrap promulgated by the Institute Of Scrap Recycling Industries, Inc., the term "Zorba" is the collective term for shredded nonferrous metals, including, but not limited to, those originating from end-of-life vehicles ("ELVs") or waste electronic and electrical equipment ("WEEE"). The Institute Of Scrap Recycling Industries, Inc. ("ISRI") in the United States established the specifications for Zorba. In Zorba, each scrap piece may be made up of a combination of the nonferrous metals: aluminum, copper, lead, magnesium, stainless steel, nickel, tin, and zinc, in elemental or alloyed (solid) form. Furthermore, the term "Twitch" shall mean fragmented aluminum scrap. Twitch may be produced by a float process whereby the aluminum scrap floats to the top because heavier metal scrap pieces sink (for example, in some processes, sand may be mixed in to change the density of the water in which the scrap is immersed).

As used herein, the terms "identify" and "classify," and the terms "identification" and "classification," may be utilized interchangeably. For example, in accordance with certain embodiments of the present disclosure, a vision system (as further described herein) may be configured (e.g., with a machine learning system) to collect any type of information that can be utilized within a sorting system to selectively sort materials (e.g., scrap pieces) as a function of a set of one or more (user-defined) physical characteristics, including, but not limited to, color, hue, size, shape, texture, physical appearance, uniformity, and/or manufacturing type of the scrap pieces. As used herein, "manufacturing type" refers to the type of manufacturing process by which the material in a scrap piece was manufactured, such as a metal part having been formed by a wrought process, having been cast (including, but not limited to, expendable mold casting, permanent mold casting, and powder metallurgy), having been forged, a material removal process, extruded, etc.

The material sorting systems described herein according to certain embodiments of the present disclosure receive a heterogeneous mixture of a plurality of materials (e.g., scrap pieces), wherein at least one material within this heterogeneous mixture includes a composition of elements different from one or more other materials and/or at least one material within this heterogeneous mixture was manufactured differently from one or more other materials. Though all embodiments of the present disclosure may be utilized to sort any types or classes of materials as defined herein, certain embodiments of the present disclosure are hereinafter described for sorting metal alloy scrap pieces, including aluminum alloy scrap pieces, and including between wrought, extruded, and/or cast aluminum scrap pieces.

It should be noted that the materials to be sorted may have irregular sizes and shapes (e.g., see FIGS. 10A-11I). For example, such material (e.g., Zorba and/or Twitch) may have been previously run through some sort of shredding mechanism that chops up the materials into such irregularly shaped and sized pieces (producing scrap pieces), which may then be fed onto a conveyor system.

Embodiments of the present disclosure will be described herein as sorting materials (e.g., scrap pieces) into such separate groups by physically depositing (e.g., ejecting) the materials (e.g., scrap pieces) into separate receptacles or bins as a function of user-defined groupings (e.g., material type classifications). As an example, within certain embodiments of the present disclosure, materials (e.g., scrap pieces) may be sorted into separate bins in order to separate materials (e.g., scrap pieces) composed of wrought aluminum from other materials (e.g., scrap pieces) composed of cast and/or extruded aluminum.

As previously disclosed herein, though x-ray transmission technology can be used to sort between some cast, extruded, and/or wrought aluminum alloys, it does not classify all of the cast and/or extruded alloys correctly due to the large variance in their respective densities. The use of artificial intelligence, however, does not use density to make the decision of whether the alloy is cast, extruded, or wrought, and therefore, does not suffer from this problem. Recent melt test results by the inventors show that sorter technology as configured in accordance with embodiments of the present disclosure is >99% accurate in its ability to distinguish between cast, extruded, and/or wrought aluminum alloys. This accuracy is far greater than the x-ray transmission technology, and enables a cost-effective method for sorting between cast aluminum, extruded aluminum, and/or wrought aluminum alloys. As referenced herein, a melt test is when selected metal scrap pieces are melted together, and a composition analysis is performed on the melted together scrap to determine the percentages of the various metals existing within the melt.

FIG. 3 illustrates a table listing chemical composition limits required for several common aluminum alloys utilized to manufacture various end products. Therefore, any satisfactory recycling process should be efficient and cost effective for producing end products that adhere to such chemical composition limits.

The aluminum scrap called Twitch typically includes a mixture of various aluminum scrap alloys from automobiles, construction/demolition projects, refrigerators, washing machines, some soda cans, and other appliances. This may include cast, extruded, and/or wrought alloys, and thus may contain significant amounts of Si, Mg, Fe, Mn, Cu, and Zn, and can vary significantly from lot to lot depending on the composition of scrap metals being shredded.

FIG. 4 illustrates a table listing data obtained from a melt test of a batch of Twitch. As can be seen from the composition of the melted Twitch that it contains a significantly high content of silicon, such that none of the wrought alloys such as 3105 or 6061 (e.g., see FIG. 3) can be fabricated from the mixed scrap, because silicon cannot be removed from the molten aluminum. Thus, currently, typical shredded lots of Twitch are melted to manufacture the lowest grade aluminum (i.e., 380 series cast aluminum, which can be used for engine block castings). However, as shown in FIG. 4, typical Twitch contains a significant amount of magnesium, which needs to be significantly removed (e.g., to less than 1% of the composition, or even less than 0.5% in some situations) to obtain the 380 composition. The current method of choice is bubbling chlorine gas through the molten Twitch to produce magnesium chloride, which can be removed as slag from the molten Twitch. However, chlorine is a toxic substance, and its removal by such methods results in extra costs associated with the process and the fact that it is toxic. Additionally, such a Mg/Cl process results in a loss of some of the aluminum.

Figure 7:
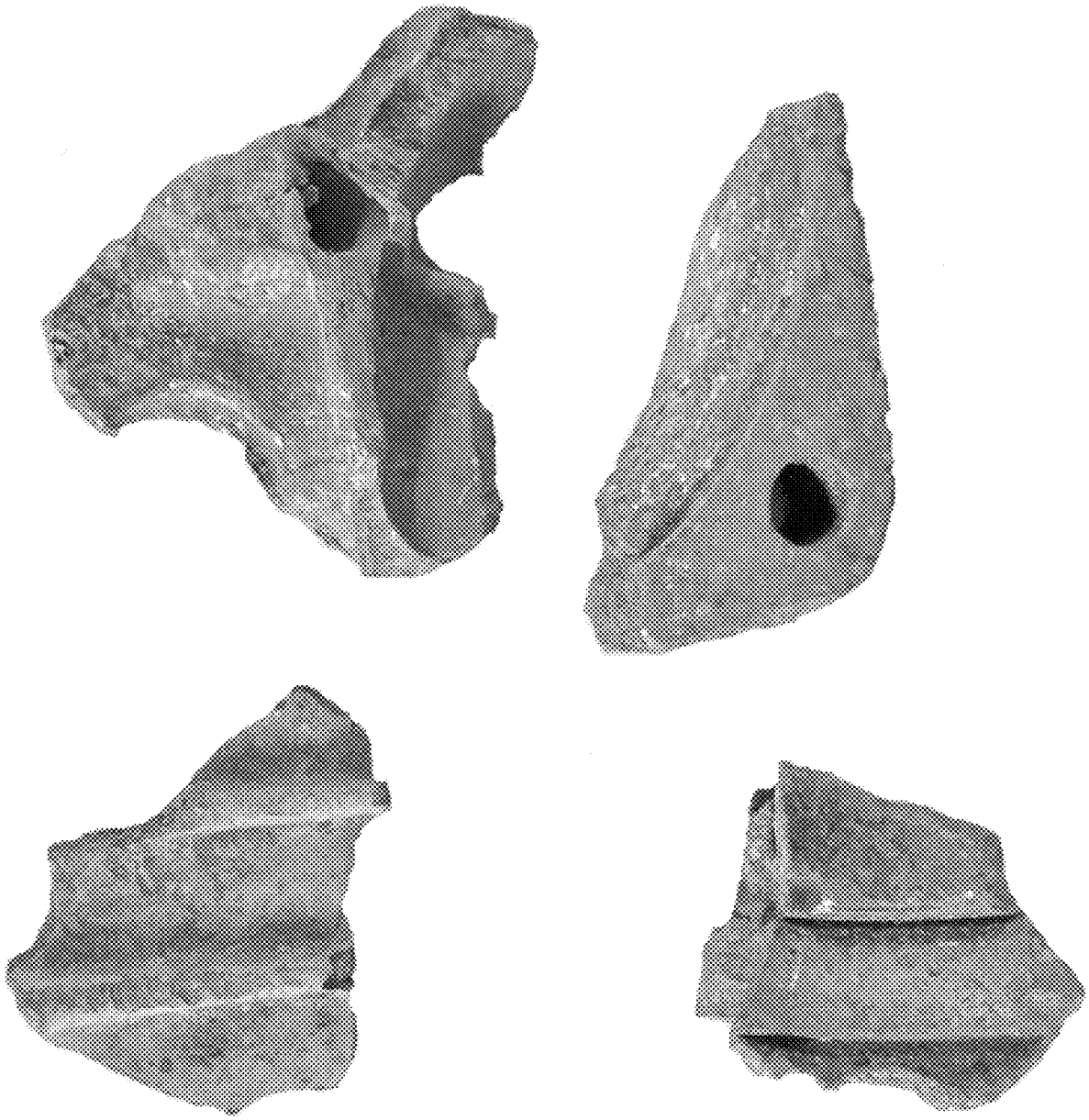
FIG. 7 shows visual images of exemplary scrap pieces from cast aluminum.
Figure 8:
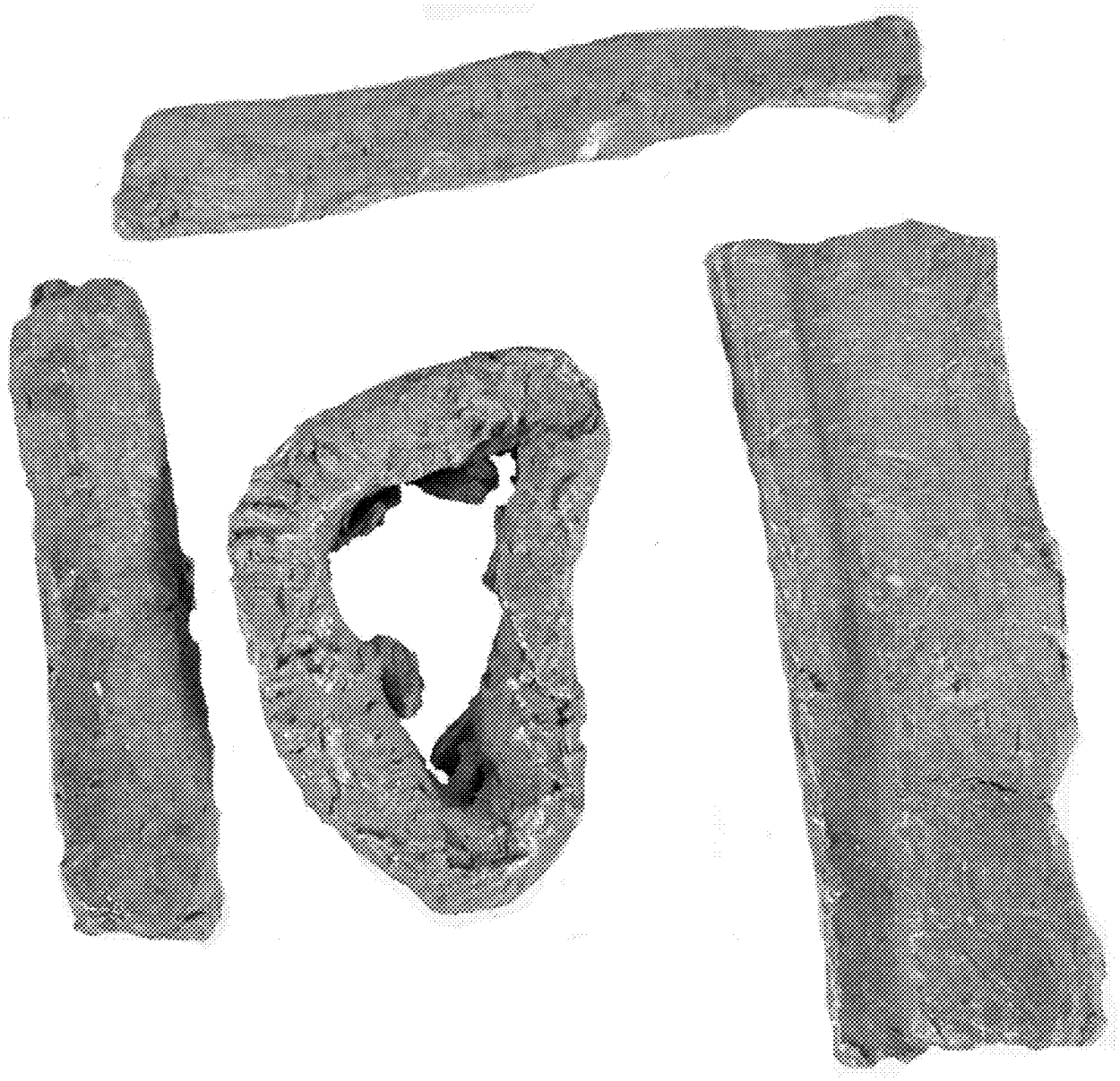
FIG. 8 shows visual images of exemplary scrap pieces from aluminum extrusions.
Figure 9:
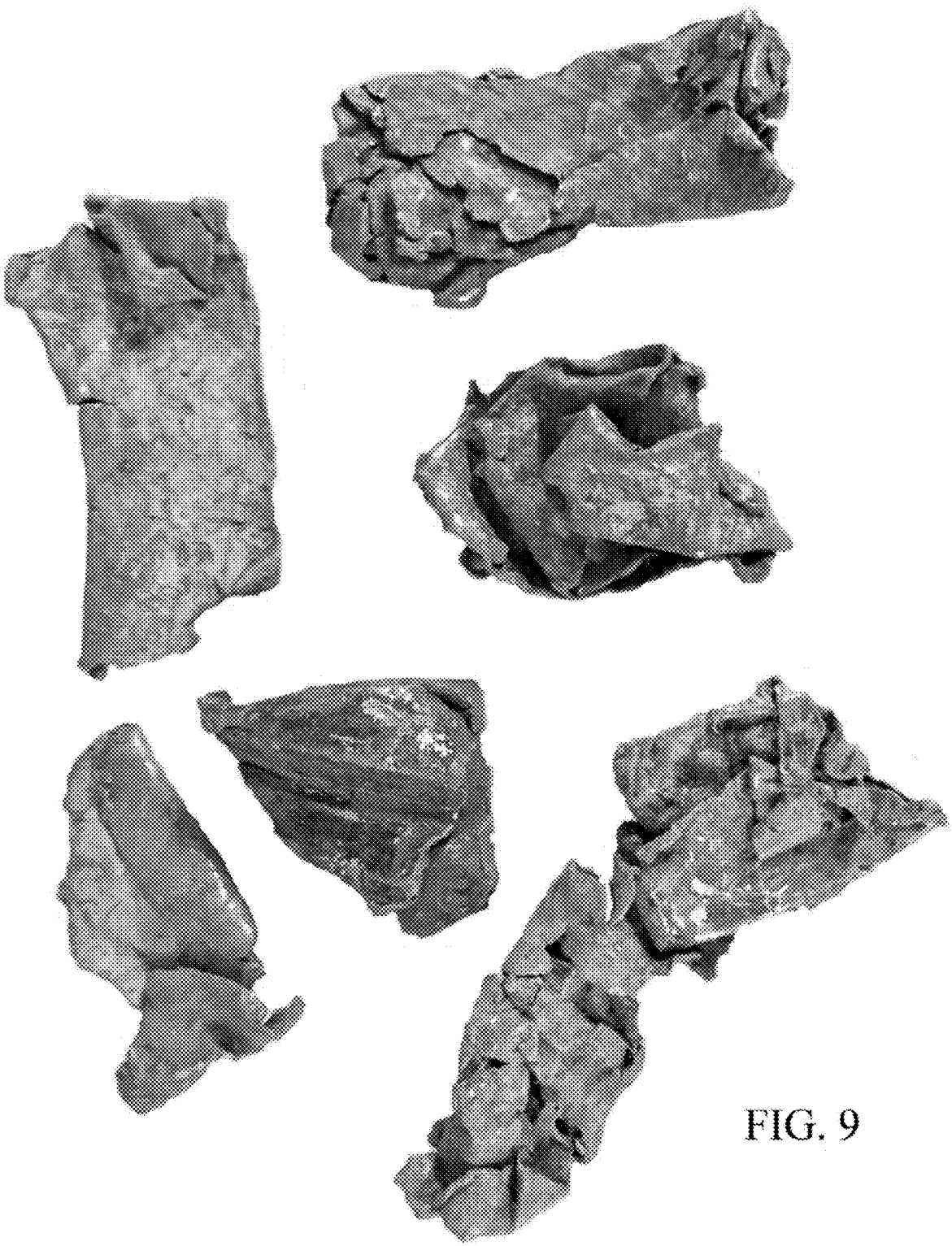
FIG. 9 shows visual images of exemplary scrap pieces from wrought aluminum.
Figure 10A:
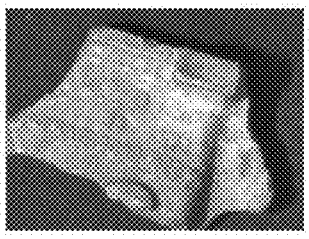
FIGS. 10A, 10B, 10C, 10D, 10E, 10F, 10G, 10H and 10I show visual images of various exemplary scrap pieces of cast aluminum.
Figure 10B:
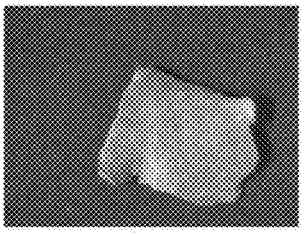
Figure 10C:
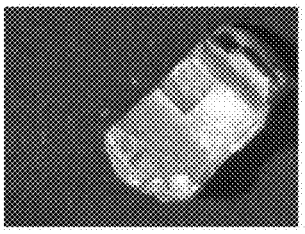
Figure 10D:
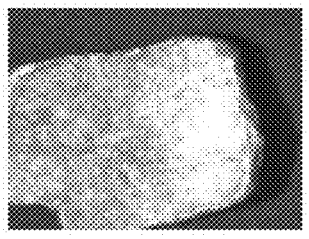
Figure 10E:
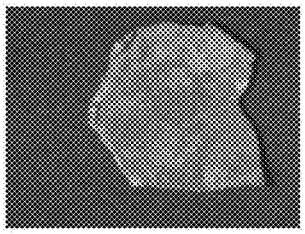
Figure 10F:
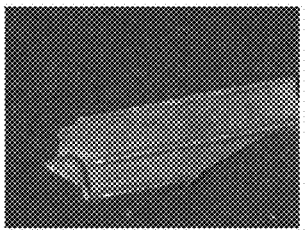
Figure 10G:
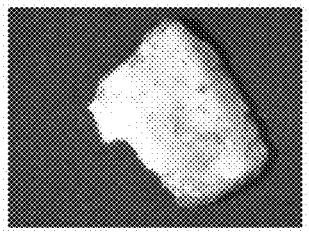
Figure 10H:
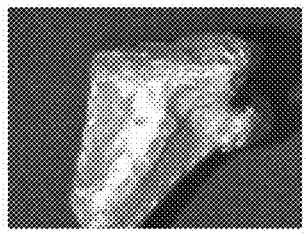
Figure 10I:
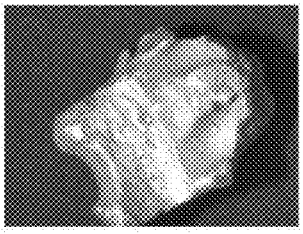
Figure 11A:
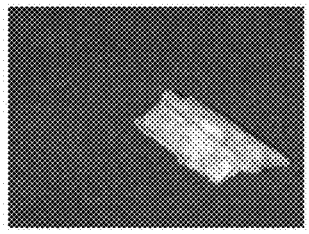
FIGS. 11A, 11B, 11C, 11D, 11E, 11F, 11G, 11H and 11I show visual images of various exemplary scrap pieces of wrought aluminum.
Figure 11B:
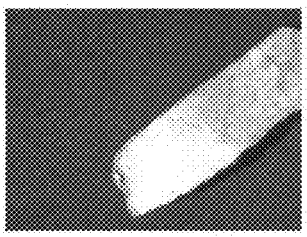
Figure 11C:
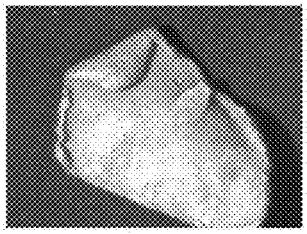
Figure 11D:
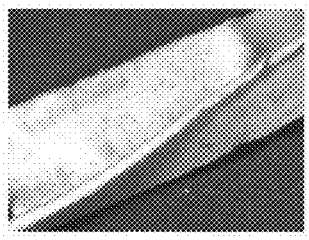
Figure 11E:
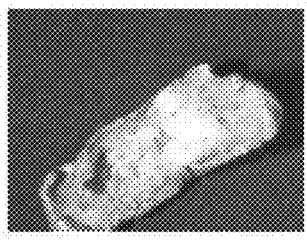
Figure 11F:
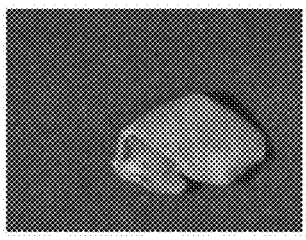
Figure 11G:
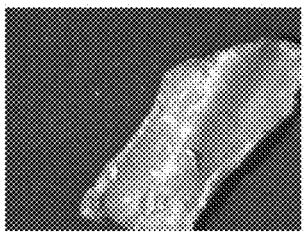
Figure 11H:
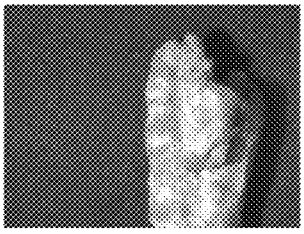
Figure 11I:
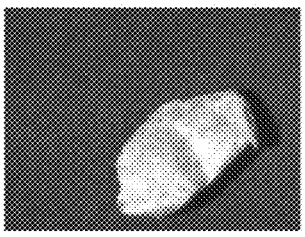

After going through a shredder, sidings (typically made from thin aluminum sheets), extrusions (typically manufactured from thick aluminum framing bars), and castings look very different. FIG. 7 shows visual images of exemplary scrap pieces from cast aluminum. FIG. 8 shows visual images of exemplary scrap pieces from aluminum extrusions. FIG. 9 shows visual images of exemplary scrap pieces from wrought aluminum. Composition-wise, extruded aluminum has a similar composition as wrought aluminum (because of the relatively low amount (<1.5%) of silicon), while all types of cast aluminum will contain more than 5% silicon.

Embodiments of the present disclosure utilize a vision system as described herein capable of sorting between these three different types of aluminum scrap pieces. In doing so, the utilization of chlorine is not required, while resulting in recycled cast aluminum having less than 1% Mg in the final composition of the sorted scrap pieces (or ingots made from the sorted scrap pieces), and even less than 0.5% Mg.

Embodiments of the present disclosure sort the wrought aluminum from the Twitch, which contains both wrought and cast aluminum scrap pieces. In certain embodiments of the present disclosure, extruded aluminum can be sorted with the wrought aluminum. Since most of the Mg is within the wrought aluminum, the remaining aluminum scrap pieces, containing mostly cast aluminum, have relatively insignificant amounts of Mg. In accordance with certain embodiments of the present disclosure, another sort (or plurality of sorting cycles) can be performed on these remaining aluminum scrap pieces (also referred to herein as the cast fraction) in order to remove other impurities (e.g., scrap pieces composed of PCB, stainless steel, foam, rubber, etc.).

The cast fraction may include cast alloys such as 319, 356, 360, and/or 380 series alloy pieces. These alloys contain varying amounts of silicon, Cu, Zn, Fe, and Mn, but contain extremely small amounts of Mg, typically 0-0.6%. When the cast fraction scrap is melted, the molten aluminum can be manufactured into a cast alloy (e.g., 380 or 384 series) without the need to remove any magnesium. FIG. 5 illustrates a table listing an exemplary composition obtained from a melt test of cast aluminum scrap pieces sorted in accordance with embodiments of the present disclosure. As can be seen, the fraction of Mg is 0.08%, which is less than the previously stated goal of less than 1%.

FIG. 6 illustrates a table listing percentages of metals in a composition obtained from a melt test of wrought aluminum scrap pieces sorted from Twitch in accordance with embodiments of the present disclosure. As is clear, the sorted wrought fraction can be used for fabricating any of the wrought alloys by adding small amounts of the required metals (for example, see FIG. 3). Furthermore, in accordance with embodiments of the present disclosure, the wrought fraction can be sorted again into sheet metal scrap and extrusion scrap fractions. These can be melted separately to manufacture either 3105, 5052, or 6061 alloys (e.g., see FIG. 3). As shown by the examples in FIGS. 7-9, aluminum extrusions have an overall physical appearance that is distinguishable from cast and wrought aluminum scrap pieces, which can be learned by a machine learning system configured in accordance with embodiments of the present disclosure.

FIG. 1 illustrates an example of a material sorting system 100 configured in accordance with various embodiments of the present disclosure to automatically (i.e., does not require human manual intervention) sort materials. A conveyor system 103 may be implemented to convey one or more streams of individual scrap pieces 101 (e.g., Twitch scrap) through the sorting system 100 so that each of the individual scrap pieces 101 can be tracked, classified, and sorted into predetermined desired groups. Such a conveyor system 103 may be implemented with one or more conveyor belts on which the scrap pieces 101 travel, typically at a predetermined constant speed. However, certain embodiments of the present disclosure may be implemented with other types of conveyor systems, including a system in which the scrap pieces free fall past the various components of the sorting system. Hereinafter, the conveyor system 103 will simply be referred to as the conveyor belt 103.

Furthermore, though the illustration in FIG. 1 depicts a single stream of scrap pieces 101 on a conveyor belt 103, embodiments of the present disclosure may be implemented in which a plurality of such streams of scrap pieces are passing by the various components of the sorting system 100 in parallel with each other, or a collection of scrap pieces deposited in a random manner onto a conveyor system (e.g., the conveyor belt 103) are passed by the various components of the system 100. As such, certain embodiments of the present disclosure are capable of simultaneously tracking, classifying, and sorting a plurality of such parallel travelling streams of scrap pieces, or scrap pieces randomly deposited onto a conveyor system (belt). In accordance with embodiments of the present disclosure, singulation of the scrap pieces 101 is not required for the vision system to track, classify, and sort the scrap pieces.

In accordance with certain embodiments of the present disclosure, some sort of suitable feeder mechanism may be utilized to feed the scrap pieces 101 onto the conveyor belt 103, whereby the conveyor belt 103 conveys the scrap pieces 101 past various components within the sorting system 100. Within certain embodiments of the present disclosure, the conveyor belt 103 is operated to travel at a predetermined speed by a conveyor belt motor 104. This predetermined speed may be programmable and/or adjustable by the operator in any well-known manner. Monitoring of the predetermined speed of the conveyor belt 103 may alternatively be performed with a position detector 105. Within certain embodiments of the present disclosure, control of the conveyor belt motor 104 and/or the position detector 105 may be performed by an automation control system 108. Such an automation control system 108 may be operated under the control of a computer system 107 and/or the functions for performing the automation control may be implemented in software within the computer system 107.

The conveyor belt 103 may be a conventional endless belt conveyor employing a conventional drive motor 104 suitable to move the conveyor belt 103 at the predetermined speeds. A position detector 105, which may be a conventional encoder, may be operatively coupled to the conveyor belt 103 and the automation control system 108 to provide information corresponding to the movement (e.g., speed) of the conveyor belt 103. Thus, as will be further described herein, through the utilization of the controls to the conveyor belt drive motor 104 and/or the automation control system 108 (and alternatively including the position detector 105), as each of the scrap pieces 101 travelling on the conveyor belt 103 are identified, they can be tracked by location and time (relative to the system 100) so that the various components of the sorting system 100 can be activated/deactivated as each scrap piece 101 passes within their vicinity. As a result, the automation control system 108 is able to track the location of each of the scrap pieces 101 while they travel along the conveyor belt 103.

In accordance with certain embodiments of the present disclosure, after the scrap pieces 101 are received by the conveyor belt 103, a tumbler and/or a vibrator (not shown) may be utilized to separate the individual scrap pieces from a collection of scrap pieces. In accordance with alternative embodiments of the present disclosure, the scrap pieces may be positioned into one or more singulated (i.e., single file) streams, which may be performed by an optional active or passive singulator 106. As previously discussed, incorporation or use of a singulator is not required. Instead, the conveyor system (e.g., the conveyor belt 103) may simply convey a collection of scrap pieces, which have been deposited onto the conveyor belt 103 in a random manner.

Referring again to FIG. 1, embodiments of the present disclosure may utilize a vision, or optical recognition, system 110 as a means to begin tracking each of the scrap pieces 101 as they travel on the conveyor belt 103. The vision system 110 may utilize one or more still or live action cameras 109 to note the position (i.e., location and timing) of each of the scrap pieces 101 on the moving conveyor belt 103. The vision system 110 may be further configured to perform certain types of identification (e.g., classification) of all or a portion of the scrap pieces 101. For example, such a vision system 110 may be utilized to acquire information about each of the scrap pieces 101. For example, the vision system 110 may be configured (e.g., with a machine learning system) to collect any type of information that can be utilized within the system 100 to selectively sort the scrap pieces 101 as a function of a set of one or more (user-defined) physical characteristics, including, but not limited to, color, hue, size, shape, texture, overall physical appearance, uniformity, composition, and/or manufacturing type of the scrap pieces 101. The vision system 110 captures visual images of each of the scrap pieces 101, for example, by using an optical sensor as utilized in typical digital cameras and video equipment. Such images captured by the optical sensor may then be stored in a memory device as image data. In accordance with embodiments of the present disclosure, such image data represents images captured within optical wavelengths of light (i.e., the wavelengths of light that are observable by the typical human eye). However, alternative embodiments of the present disclosure may utilize optical sensors that are configured to capture an image of a material made up of wavelengths of light outside of the visual wavelengths of the typical human eye.

Additionally, such a vision system 110 may be configured to identify which of the scrap pieces 101 are not of the kind to be sorted by the sorting system 100 (e.g., scrap pieces classified as other than wrought and cast aluminum scrap), and send a signal to reject such scrap pieces. In such a configuration, the identified scrap pieces 101 may be ejected utilizing one of the mechanisms as described herein for physically moving sorted scrap pieces into individual bins.

Figure 2:
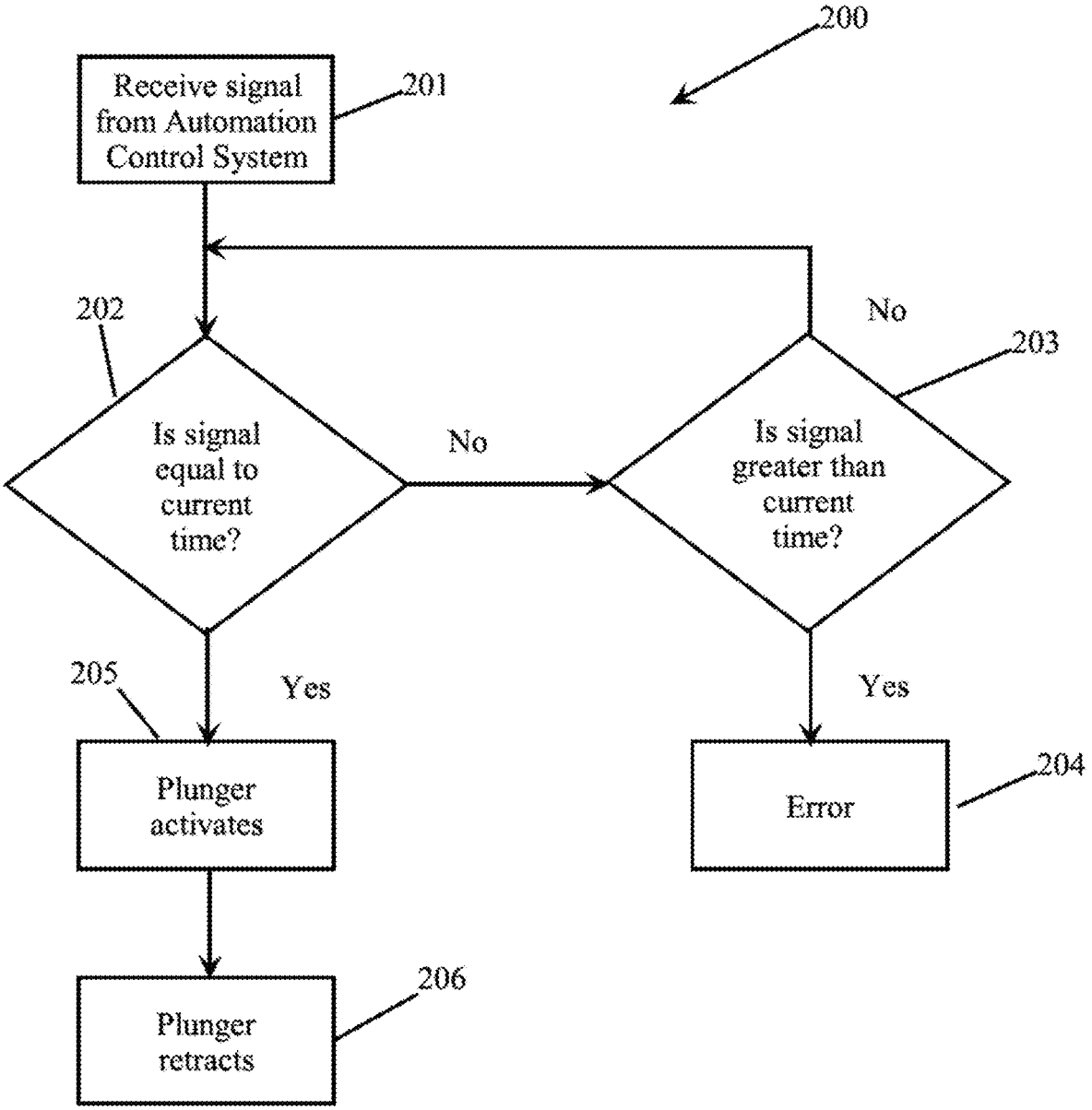
FIG. 2 illustrates a flowchart diagram of an operation of a sorting device configured in accordance with embodiments of the present disclosure.

Referring next to FIG. 2, there is illustrated a system and process 200 for activation of each one of the sorting devices (e.g., the sorting devices 126 . . . 129) for ejecting a classified scrap piece into a sorting bin. Such a system and process 200 may be implemented within the automation control system 108 previously described with respect to FIG. 1, or within an overall computer system (e.g., the computer system 107) controlling the sorting system. In the process block 201, a signal is received from the automation control system 108 that a specified and tracked scrap piece is in position for sorting. In process block 202, a determination is made whether the timing associated with this signal is equal to the current time. The system and process 200 determines whether the timing associated with the classified scrap piece corresponds to the expected time in which the classified scrap piece is passing within the proximity of the particular sorting device (e.g., air jet, pneumatic plunger, paint brush type plunger, etc.) associated with the classification pertaining to the classified scrap piece. If the timing signals do not correspond, a determination is made in the process block 203 whether the signal is greater than the current time. If YES, the system may return an error signal 204. In such an instance, the system may not be able to eject the piece into the appropriate bin. Once the system and process 200 determines that a classified scrap piece is passing within the vicinity of a sorting device associated with that classification, it will activate that sorting device in the process block 205 in order to eject the classified scrap piece into the sorting bin associated with that classification. This may be performed by activating a pneumatic plunger, paint brush type plunger, air jet, etc. In the process block 206, the selected sorting device is then deactivated.

As previously noted, the sorting devices may include any well-known mechanisms for redirecting selected scrap pieces towards a desired location, including, but not limited to, ejecting the scrap pieces from the conveyor belt system into the plurality of sorting bins. For example, a sorting device may utilize air jets, with each of the air jets assigned to one or more of the classifications. When one of the air jets (e.g., 127) receives a signal from the automation control system 108, that air jet emits a stream of air that causes a scrap piece 101 to be ejected from the conveyor belt 103 into a sorting bin (e.g., 137) corresponding to that air jet. High speed air valves from Mac Industries may be used, for example, to supply the air jets with an appropriate air pressure configured to eject the scrap pieces 101 from the conveyor belt 103.

Although the example illustrated in FIG. 1 uses air jets to eject scrap pieces, other mechanisms may be used to eject the scrap pieces, such as robotically removing the scrap pieces from the conveyor belt, pushing the scrap pieces from the conveyor belt (e.g., with paint brush type plungers), causing an opening (e.g., a trap door) in the conveyor belt from which a scrap piece may drop, or using air jets to separate the scrap pieces into separate bins as they fall from the edge of the conveyor belt.

In addition to the N sorting bins 136 . . . 139 into which scrap pieces 101 are ejected, the system 100 may also include a receptacle or bin 140 that receives scrap pieces 101 not ejected from the conveyor belt 103 into any of the aforementioned sorting bins 136 . . . 139. For example, a scrap piece 101 may not be ejected from the conveyor belt 103 into one of the N sorting bins 136 . . . 139 when the classification of the scrap piece 101 is not determined (or simply because the sorting devices failed to adequately eject a piece). Thus, the bin 140 may serve as a default receptacle into which unclassified scrap pieces are dumped. Alternatively, the bin 140 may be used to receive one or more classifications of scrap pieces that have deliberately not been assigned to any of the N sorting bins 136 . . . 139. For example, in accordance with embodiments of the present disclosure, scrap pieces not classified as wrought aluminum (and thus classified as cast aluminum) may be allowed to pass into the bin 140.

Depending upon the variety of classifications of scrap pieces desired, multiple classifications may be mapped to a single sorting device and associated sorting bin. In other words, there need not be a one-to-one correlation between classifications and sorting bins. For example, it may be desired by the user to sort certain classifications of materials (e.g., all scrap materials not classified as cast aluminum) into the same sorting bin. To accomplish this sort, when a scrap piece 101 is classified as falling into a predetermined grouping of classifications, the same sorting device may be activated to sort these into the same sorting bin. Such combination sorting may be applied to produce any desired combination of sorted scrap pieces. The mapping of classifications may be programmed by the user (e.g., using the sorting algorithm (e.g., see FIG. 12) operated by the computer system 107) to produce such desired combinations. Additionally, the classifications of scrap pieces are user-definable, and not limited to any particular known classifications of scrap pieces.

The conveyor system 103 may include a circular conveyor (not shown) so that unclassified scrap pieces are returned to the beginning of the sorting system 100 to be run through the system 100 again. Moreover, because the system 100 is able to specifically track each scrap piece 101 as it travels on the conveyor system 103, some sort of sorting device (e.g., the sorting device 129) may be implemented to eject a scrap piece 101 that the system 100 has failed to classify after a predetermined number of cycles through the sorting system 100.

Within certain embodiments of the present disclosure, the conveyor belt 103 may be divided into multiple belts configured in series such as, for example, two belts, where a first belt conveys the scrap pieces past the vision system, and a second belt conveys the scrap pieces from the vision system to the sorting devices. Moreover, such a second conveyor belt may be at a lower height or elevation than the first conveyor belt, such that the scrap pieces fall from the first belt onto the second belt.

As previously noted, embodiments of the present disclosure may implement one or more vision systems (e.g., vision system 110) in order to identify, track, and/or classify scrap pieces.

Such a vision system may be configured with one or more devices for capturing or acquiring images of the scrap pieces as they pass by on a conveyor system. The devices may be configured to capture or acquire any desired range of wavelengths reflected by the scrap pieces, including, but not limited to, visible, infrared ("IR"), ultraviolet ("UV") light. For example, the vision system may be configured with one or more cameras (still and/or video, either of which may be configured to capture two-dimensional, three-dimensional, and/or holographical images) positioned in proximity (e.g., above) the conveyor system so that visual images of the scrap pieces are captured as they pass by the vision system(s).

Regardless of the type(s) of images captured of the scrap pieces, the images may then be sent to a computer system (e.g., computer system 107) to be processed by a machine learning system in order to identify and/or classify each of the scrap pieces for subsequent sorting of the scrap pieces in a desired manner. Such a machine learning system may implement one or more any well-known machine learning algorithms, including one that implements a neural network (e.g., artificial neural network, deep neural network, convolutional neural network, recurrent neural network, autoencoders, reinforcement learning, etc.), fuzzy logic, artificial intelligence ("AI"), deep learning algorithms, deep structured learning hierarchical learning algorithms, support vector machine ("SVM") (e.g., linear SVM, nonlinear SVM, SVM regression, etc.), decision tree learning (e.g., classification and regression tree ("CART"), ensemble methods (e.g., ensemble learning, Random Forests, Bagging and Pasting, Patches and Subspaces, Boosting, Stacking, etc.), dimensionality reduction (e.g., Projection, Manifold Learning, Principal Components Analysis, etc.) and/or deep machine learning algorithms, such as those described in and publicly available at the deeplearning.net website (including all software, publications, and hyperlinks to available software referenced within this website), which is hereby incorporated by reference herein. Non-limiting examples of publicly available machine learning algorithms, software, and libraries that could be utilized within embodiments of the present disclosure include Python, OpenCV, Inception, Theano, Torch, PyTorch, Pylearn2, Numpy, Blocks, TensorFlow, MXNet, Caffe, Lasagne, Keras, Chainer, Matlab Deep Learning, CNTK, MatConvNet (a MATLAB toolbox implementing convolutional neural networks for computer vision applications), DeepLearnToolbox (a Matlab toolbox for Deep Learning (from Rasmus Berg Palm)), BigDL, Cuda-Convnet (a fast C++/CUDA implementation of convolutional (or more generally, feed-forward) neural networks), Deep Belief Networks, RNNLM, RNNLIB-RNNLIB, matrbm, deeplearning4j, Eblearn.lsh, deepmat, MShadow, Matplotlib, SciPy, CXXNET, Nengo-Nengo, Eblearn, cudamat, Gnumpy, 3-way factored RBM and mcRBM, mPoT (Python code using CUDAMat and Gnumpy to train models of natural images), ConvNet, Elektronn, OpenNN, NeuralDesigner, Theano Generalized Hebbian Learning, Apache Singa, Lightnet, and SimpleDNN.

Machine learning often occurs in two stages, or phases. For example, first, training occurs offline in that the sorting system 100 is not being utilized to perform actual sorting of scrap pieces. In accordance with certain embodiments of the present disclosure, a portion of the system 100 may be utilized to train the machine learning system in that one or more homogenous sets of scrap pieces (i.e., having the same material composition (e.g., aluminum (cast or wrought))) are passed by the vision system 110 by the conveyor system 103 (and all such scrap pieces are not sorted, but may be collected in a common bin (e.g., bin 140)). Alternatively, the training may be performed at another location remote from the system 100, including using some other mechanism for collecting images of homogenous sets of scrap pieces. During this training stage, the machine learning algorithm(s) extract features from the captured images using image processing techniques well known in the art. Non-limiting examples of training algorithms include, but are not limited to, linear regression, gradient descent, feed forward, polynomial regression, learning curves, regularized learning models, and logistic regression. It is during this training stage that the machine learning algorithm(s) learn the relationships between different types of materials and their features (e.g., as captured by the images, such as color, texture, hue, shape, brightness, overall physical appearance, etc.), creating a knowledge base for later classification of a heterogeneous mixture of scrap pieces received by the sorting system 100 for sorting by desired classifications. Such a knowledge base may include one or more libraries, wherein each library includes parameters for utilization by the vision system 110 in classifying and sorting scrap pieces during the second stage, or phase. For example, one particular library may include parameters configured by the training stage to recognize and classify a particular material (e.g., either wrought aluminum or cast aluminum or extruded aluminum). In accordance with certain embodiments of the present disclosure, such libraries may be inputted into the vision system and then the user of the system 100 may be able to adjust certain ones of the parameters in order to adjust an operation of the system 100 (for example, adjusting the threshold effectiveness of how well the vision system recognizes a particular material (e.g., wrought aluminum and/or cast aluminum and/or extruded aluminum) from a heterogeneous mixture of materials).

Additionally, it is well-known that the inclusion of certain materials (e.g., chemical elements or compounds) in scrap pieces (e.g., metal alloys), or combinations of certain chemical elements or compounds, result in identifiable physical features (e.g., visually discernible characteristics) in materials, As a result, when a plurality of scrap pieces containing such a particular composition are passed through the aforementioned training stage, the machine learning system can learn how to distinguish such scrap pieces from others. Consequently, a machine learning system configured in accordance with certain embodiments of the present disclosure may be configured to sort between materials (e.g., scrap pieces) as a function of their respective material/chemical compositions. For example, such a machine learning system may be configured so that aluminum alloys can be sorted as a function of the percentage of a specified alloying material contained within the aluminum alloys.

For example, FIGS. 10A-10I show captured or acquired images of exemplary scrap pieces of cast aluminum, which may be used during the aforementioned training stage. FIGS. 11A-11I show captured or acquired images of exemplary scrap pieces of wrought aluminum, which may be used during the aforementioned training stage. During the training stage, a plurality of scrap pieces of a particular (homogenous) classification (type) of material, which are the control samples, may be delivered past the vision system by the conveyor system so that the machine learning system detects, extracts, and learns what features visually represent such exemplary materials (e.g., scrap pieces). In other words, images of cast aluminum pieces such as shown in FIGS. 10A-10I may be first passed through such a training stage so that the machine learning algorithm "learns" how to detect, recognize, and classify scrap pieces made of cast aluminum. This creates a library of parameters particular to cast aluminum scrap pieces. Then, the same process can be performed with respect to images of wrought aluminum pieces, such as shown in FIGS. 11A-11I, creating a library of parameters particular to wrought aluminum scrap pieces. For each type of material to be classified by the vision system, any number of exemplary scrap pieces of that type of material may be passed by the vision system. Given a captured image as input data, the machine learning algorithms may use N classifiers, each of which test for one of N different material types.

Secondly, after the algorithms have been established and the machine learning system has sufficiently learned the differences for the material classifications, the libraries for the different materials are then implemented into the material sorting system (e.g., the system 100) to be used for identifying and/or classifying and then sorting scrap pieces (e.g., sorting between cast aluminum scrap pieces and wrought aluminum scrap pieces).

One point of mention here is that the detected/extracted features (e.g., observed characteristics) are not necessarily simply corners, or brightness, or shapes; they can be abstract formulations that can only be expressed mathematically, or not mathematically at all; nevertheless, the machine learning system parses all of the data to look for patterns (e.g., observable) that allow the control samples to be classified during the training stage. The machine learning system may take subsections of a captured image of a scrap piece and attempt to find correlations between the pre-defined classifications (e.g., wrought aluminum and cast aluminum).

Figure 12:
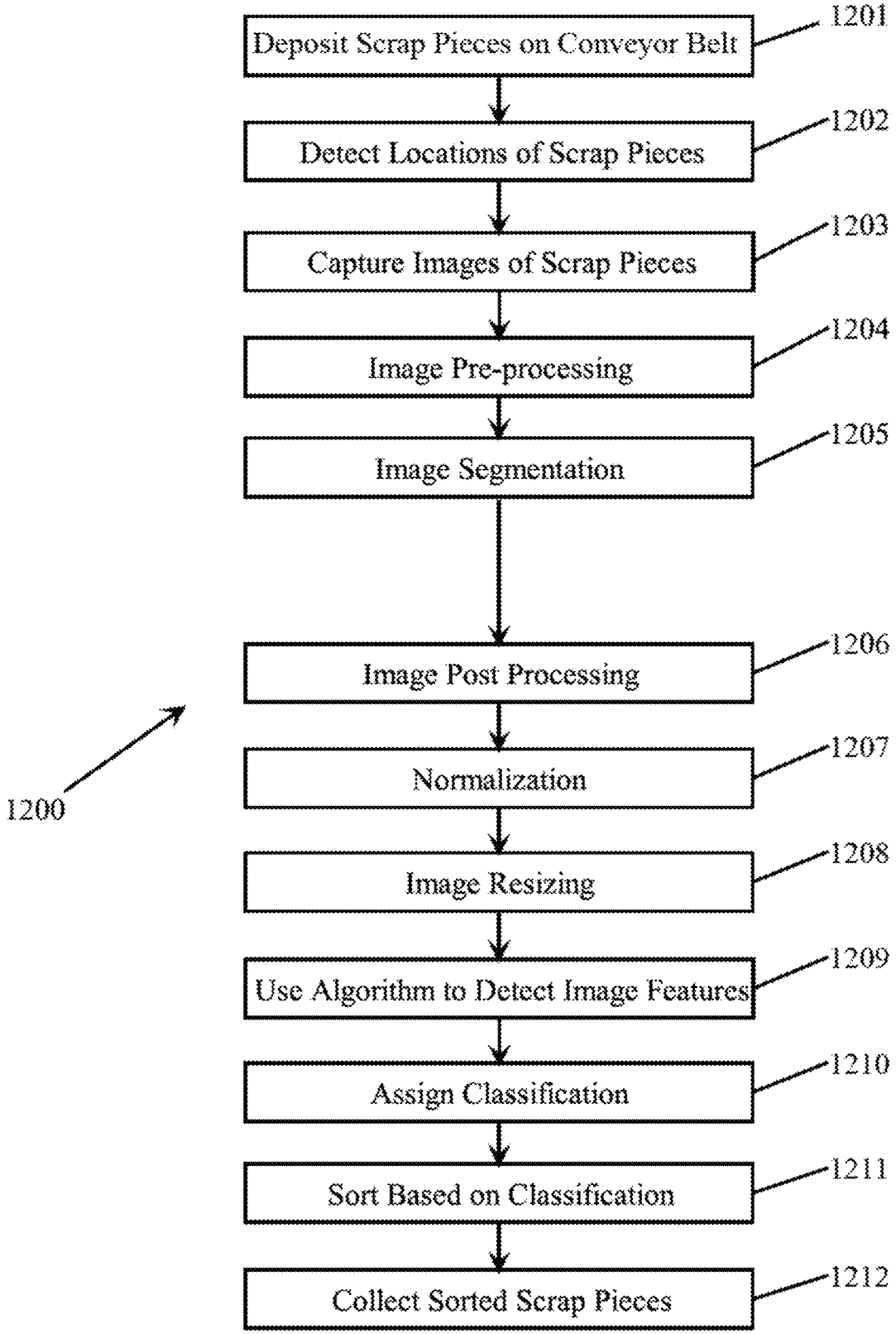
FIG. 12 illustrates a flowchart diagram configured in accordance with embodiments of the present disclosure.

FIG. 12 illustrates a flowchart diagram depicting exemplary embodiments of a process 1200 of sorting scrap pieces utilizing a vision system in accordance with certain embodiments of the present disclosure. Aspects of the process 1200 may be configured to operate within any of the embodiments of the present disclosure described herein, including the sorting system 100 of FIG. 1. Operation of the process 1200 may be performed by hardware and/or software, including within a computer system (e.g., computer system 3400 of FIG. 14) controlling the sorting system (e.g., the computer system 107 and/or the vision system 110 of FIG. 1). In the process block 1201, the scrap pieces may be deposited onto a conveyor belt. In the process block 1202, the location on the conveyor belt 103 of each scrap piece 101 is detected for tracking of each scrap piece as it travels through the sorting system. This may be performed by the vision system 110 (for example, by distinguishing a scrap piece from the underlying conveyor belt material while in communication with a conveyor belt position detector (e.g., the position detector 105)). Alternatively, a linear sheet laser beam can be used to locate the pieces, (or, any system that can create a light source (including, but not limited to, visual light, UV, VIS, and IR) and have a detector can be used to locate the pieces). In the process block 1203, when a scrap piece has traveled in proximity to the vision system 110, an image of the scrap piece is captured/acquired. In the process block 1204, a machine learning system, such as previously disclosed, may perform pre-processing of the images, which may be utilized to detect (extract) each of the scrap pieces from the background (e.g., the conveyor belt). In other words, the image pre-processing may be utilized to identify the difference between the scrap piece and the background. Well-known image processing techniques such as dilation, thresholding, and contouring may be utilized to identify the scrap piece as being distinct from the background. In the process block 1205, image segmentation may be performed. For example, one or more of the images captured by the camera of the vision system may include images of one or more scrap pieces. Additionally, a particular scrap piece may be located on a seam of the conveyor belt when its image is captured. Therefore, it may be desired in such instances to isolate the image of an individual scrap piece from the background of the image. In an exemplary technique for the process block 1205, a first step is to apply a high contrast of the image; in this fashion, background pixels are reduced to substantially all black pixels, and at least some of the pixels pertaining to the scrap piece are brightened to substantially all white pixels. The image pixels of the scrap piece that are white are then dilated to cover the entire size of the scrap piece. After this step, the location of the scrap piece is a high contrast image of all white pixels on a black background. Then, a contouring algorithm can be utilized to detect boundaries of the scrap piece. The boundary information is saved, and the boundary locations are then transferred to the original image. Segmentation is then performed on the original image on an area greater than the boundary that was earlier defined. In this fashion, each scrap piece is identified and separated from the background.

In the process block 1206, image post processing may be performed. Image post processing may involve resizing the image to prepare it for use in the neural networks. This may also include modifying certain image properties (e.g., enhancing image contrast, changing the image background, or applying filters) in a manner that will yield an enhancement to the capability of the machine learning system to classify the scrap pieces. Subsequent to image post processing, normalization of the various images may be performed in the process block 1207 so that the images of the various scrap pieces can be more easily compared to each other. In the process block 1208, each of the images may be resized. Image resizing may be necessary under certain circumstances to match the data input requirements for certain machine learning systems, such as neural networks. Neural networks require much smaller image sizes (e.g., 225×255 pixels or 299×299 pixels) that the sizes of the images captured by typical digital cameras. Moreover, the smaller the image size, the less processing time is needed to perform the classification. Thus, smaller image sizes can ultimately increase the throughput of the sorter system and increase its value.

In the process blocks 1209 and 1210, for each scrap piece, the type of material is identified/classified based on the detected features. For example, the process block 1209 may be configured with a neural network employing one or more machine learning algorithms, which compare the extracted features with those stored in the knowledge base generated during the training stage, and assign the classification with the highest match to each of the scrap pieces based on such a comparison. The machine learning algorithm(s) may process the captured image in a hierarchical manner by using automatically trained filters. The filter responses are then successfully combined in the next level(s) of the algorithm(s) until a probability is obtained in the final step. In the process block 1210, these probabilities may be used for each of the N (N>1) classifications to decide into which of the N sorting bins the respective scrap pieces should be sorted. For example, each of the N classifications may be assigned to one sorting bin, and the scrap piece under consideration is sorted into that bin that corresponds to the classification returning the highest probability larger than a predefined threshold. Within embodiments of the present disclosure, such predefined thresholds may be preset by the user. A particular scrap piece may be sorted into an outlier bin (e.g., sorting bin 140) if none of the probabilities is larger than the predetermined threshold.

In the process block 1211, a sorting device corresponding to the classification, or classifications, of the scrap piece is activated (e.g., see FIG. 2). Between the time at which the image of the scrap piece 101 was captured by the vision system 110 and the time at which the sorting device is activated, the scrap piece 101 has moved from the proximity of the vision system 110 to a location downstream on the conveyor belt 103, at the rate of conveying of the conveyor belt 103. In embodiments of the present disclosure, the activation of the sorting device (e.g., 126 . . . 129) is timed such that as the scrap piece 101 passes the sorting device mapped to the classification of the scrap piece, the sorting device is activated, and the scrap piece is ejected from the conveyor belt into its associated sorting bin (e.g., 136 . . . 139). Within embodiments of the present disclosure, the activation of a sorting device may be timed by the automation control system in communication with the belt speed detector 105 that detects when a scrap piece is passing before the sorting device and sends a signal to enable the activation of the sorting device. In the process block 1212, the sorting bin corresponding to the sorting device that was activated receives the ejected scrap piece.

In accordance with certain embodiments of the present disclosure, a plurality of at least a portion of the system 100 may be linked together in succession in order to perform multiple iterations or layers of sorting. For example, when two or more systems 100 are linked in such a manner, the conveyor system may be implemented with a single conveyor belt, or multiple conveyor belts, conveying the scrap pieces past a first vision system configured for sorting scrap pieces of a first set of a heterogeneous mixture of materials by a sorter (e.g., the first automation control system 108 and associated one or more sorting devices 126 . . . 129) into a first set of one or more receptacles (e.g., sorting bins 136 . . . 139), and then conveying the scrap pieces past a second vision system configured for sorting scrap pieces of a second set of a heterogeneous mixture of materials by a second sorter into a second set of one or more sorting bins.

Such successions of systems 100 can contain any number of such systems linked together in such a manner. In accordance with certain embodiments of the present disclosure, each successive vision system may be configured to sort out a different material than previous vision system(s).

Figure 13:
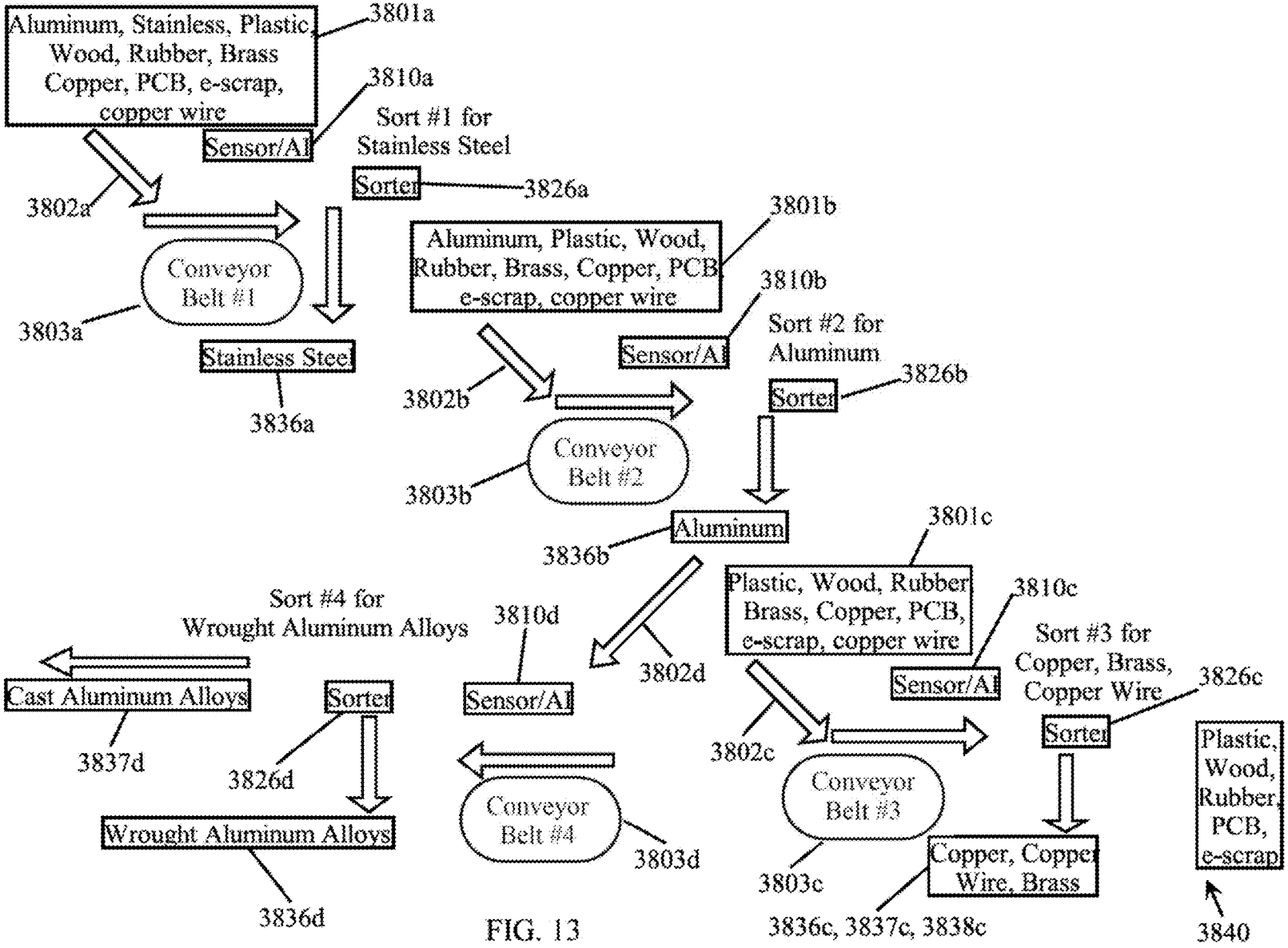
FIG. 13 illustrates linking of successive sorting systems in accordance with certain embodiments of the present disclosure.

Referring to FIG. 13, there is illustrated a schematic diagram of a non-limiting example of a linking of successive sorting systems in a manner as previously described, which may be implemented with the sorting system 100, or any similar sorting system utilizing one or more vision systems (for the sake of simplicity, with respect to the following discussion of FIG. 13, such combinations of one or more vision systems will simply be referred to as a material classification system). In FIG. 13, the various arrows schematically depict how the various scrap pieces are conveyed along such an exemplary sorting system. In this non-limiting example, four separate sorting systems are utilized, though any number of such sorting systems may be combined in any manner in order to separate and sort various different classes of materials. The example in FIG. 13 describes various classes of materials to be sorted, but embodiments of the present disclosure are applicable to the sorting of any combination of a heterogeneous mixture of scrap pieces.

In this particular example, a group of materials that includes a heterogeneous mixture 3801*a* of aluminum, stainless steel, plastic, wood, rubber, brass, copper, PCB, e-scrap, and copper wire is deposited onto a first conveyor system 3803*a* (identified as Conveyor Belt #1 in FIG. 13), for example, from a ramp or chute 3802*a* (e.g., ramp or chute 102). The conveyor system 3803*a* conveys the scrap pieces 3801*a* past a material classification system 3810*a*, which may be configured to sort the scrap pieces made of stainless steel from the remainder of the scrap pieces (identified as Sort #1) utilizing the Sorter 3826*a*, which may utilize any of the sorting devices described herein, for deposit into a receptacle or bin 3836*a*.

The remaining heterogeneous mixture of scrap pieces 3801*b* may then be conveyed along the same conveyor system, or deposited 3802*b* onto a separate conveyor system 3803*b* (identified as Conveyor Belt #2 in FIG. 13). The conveyor system 3803*b* passes these scrap pieces 3801*b* past another material classification system 3810*b*, which is configured to identify and sort the scrap pieces made of aluminum (identified as Sort #2) using the Sorter 3826*b* for depositing in a separate bin 3836*b* or other receptacle.

In this particular example, the remaining heterogeneous mixture of scrap pieces 3801*c* (minus the stainless steel and aluminum scrap pieces) is then deposited 3802*c* onto another conveyor system 3803*c* (identified as Conveyor Belt #3 in FIG. 13) for identification by the material classification system 3810*c* to be sorted by a Sorter 3826*c* (identified as Sort #3). This section of the sorting system may be configured to separate and sort scrap pieces made of copper, copper wire, and brass, which may be deposited into one or more bins. In accordance with certain embodiments of the present disclosure, each of the copper, copper wire, and brass scrap pieces may be individually sorted and deposited into separate bins for copper 3836*c*, copper wire 3837*c*, and brass 3838*c*. The remaining heterogeneous mixture of scrap pieces (plastic wood, rubber, PCB, and e-scrap) may then be deposited into a receptacle or bin 3840, or may be further processed by an additional sorting system as previously described.

Embodiments of the present disclosure are not limited to a linear succession of such sorting systems, but may include a combination of branching of such sorting systems for further classification and sorting of a particular class or classes of materials. For example, FIG. 13 illustrates how the aluminum scrap pieces 3836*b* sorted in Sort #2 may then be deposited 3802*d* onto another conveyor system 3803*d* (identified as Conveyor Belt #4 in FIG. 13). For example, the Sorter 3826*b* may physically sort such aluminum scrap pieces onto another conveyor system, such as the conveyor system, or the receptacle 3836*b* in which the aluminum scrap pieces have been deposited may be a ramp or chute for depositing the aluminum scrap pieces onto the conveyor system, or the receptacle containing the aluminum scrap pieces may simply be manipulated to deposit the aluminum scrap pieces onto the conveyor system 3803*d*. A material classification system 3810*d* may then be configured to classify these aluminum scrap pieces into cast aluminum alloys and wrought aluminum alloys (e.g., such as described herein with respect to FIGS. 10A-11I). In this Sort #4, a Sorter 3826*d* may then be configured to separate the cast aluminum alloys from the wrought aluminum alloys based on the classification by the material classification system 3810*d* whereby the cast aluminum alloys may be deposited into a bin 3837*d* and the wrought aluminum alloys may be deposited into a bin 3836*d*.

As can be readily seen, the sorting system illustrated in FIG. 13 may be modified into any combination of sorting systems for sorting materials as desired.

As has been described herein, embodiments of the present disclosure may be implemented to perform the various functions described for identifying, tracking, classifying, and sorting materials, such as scrap pieces. Such functionalities may be implemented within hardware and/or software, such as within one or more data processing systems (e.g., the data processing system 3400 of FIG. 14), such as the previously noted computer system 107, the vision system 110, and/or automation control system 108. Nevertheless, the functionalities described herein are not to be limited for implementation into any particular hardware/software platform.

As will be appreciated by one skilled in the art, aspects of the present disclosure may be embodied as a system, process, method, and/or program product. Accordingly, various aspects of the present disclosure may take the form of an entirely hardware embodiment, an entirely software embodiment (including firmware, resident software, micro-code, etc.), or embodiments combining software and hardware aspects, which may generally be referred to herein as a "circuit," "circuitry," "module," or "system." Furthermore, aspects of the present disclosure may take the form of a program product embodied in one or more computer readable storage medium(s) having computer readable program code embodied thereon. (However, any combination of one or more computer readable medium(s) may be utilized. The computer readable medium may be a computer readable signal medium or a computer readable storage medium.)

A computer readable storage medium may be, for example, but not limited to, an electronic, magnetic, optical, electromagnetic, infrared, biologic, atomic, or semiconductor system, apparatus, controller, or device, or any suitable combination of the foregoing, wherein the computer readable storage medium is not a transitory signal per se. More specific examples (a non-exhaustive list) of the computer readable storage medium may include the following: an electrical connection having one or more wires, a portable computer diskette, a hard disk, a random access memory ("RAM") (e.g., RAM 3420 of FIG. 14), a read-only memory ("ROM") (e.g., ROM 3435 of FIG. 14), an erasable programmable read-only memory ("EPROM" or flash memory), an optical fiber, a portable compact disc read-only memory ("CD-ROM"), an optical storage device, a magnetic storage device (e.g., hard drive 3431 of FIG. 14), or any suitable combination of the foregoing. In the context of this document, a computer readable storage medium may be any tangible medium that can contain or store a program for use by or in connection with an instruction execution system, apparatus, controller, or device. Program code embodied on a computer readable signal medium may be transmitted using any appropriate medium, including but not limited to wireless, wire line, optical fiber cable, RF, etc., or any suitable combination of the foregoing.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, controller, or device.

The flowchart and block diagrams in the figures illustrate architecture, functionality, and operation of possible implementations of systems, methods, processes, and program products according to various embodiments of the present disclosure. In this regard, each block in the flowcharts or block diagrams may represent a module, segment, or portion of code, which includes one or more executable program instructions for implementing the specified logical function(s). It should also be noted that, in some implementations, the functions noted in the blocks may occur out of the order noted in the figures. For example, two blocks shown in succession may, in fact, be executed substantially concurrently, or the blocks may sometimes be executed in the reverse order, depending upon the functionality involved.

Modules implemented in software for execution by various types of processors (e.g., GPU 3401, CPU 3415) may, for instance, include one or more physical or logical blocks of computer instructions, which may, for instance, be organized as an object, procedure, or function. Nevertheless, the executables of an identified module need not be physically located together, but may include disparate instructions stored in different locations which, when joined logically together, include the module and achieve the stated purpose for the module. Indeed, a module of executable code may be a single instruction, or many instructions, and may even be distributed over several different code segments, among different programs, and across several memory devices. Similarly, operational data (e.g., material classification libraries described herein) may be identified and illustrated herein within modules, and may be embodied in any suitable form and organized within any suitable type of data structure. The operational data may be collected as a single data set, or may be distributed over different locations including over different storage devices. The data may provide electronic signals on a system or network.

These program instructions may be provided to one or more processors and/or controller(s) of a general purpose computer, special purpose computer, or other programmable data processing apparatus (e.g., controller) to produce a machine, such that the instructions, which execute via the processor(s) (e.g., GPU 3401, CPU 3415) of the computer or other programmable data processing apparatus, create circuitry or means for implementing the functions/acts specified in the flowchart and/or block diagram block or blocks.

It will also be noted that each block of the block diagrams and/or flowchart illustrations, and combinations of blocks in the block diagrams and/or flowchart illustrations, can be implemented by special purpose hardware-based systems (e.g., which may include one or more graphics processing units (e.g., GPU 3401)) that perform the specified functions or acts, or combinations of special purpose hardware and computer instructions. For example, a module may be implemented as a hardware circuit including custom VLSI circuits or gate arrays, off-the-shelf semiconductors such as logic chips, transistors, controllers, or other discrete components. A module may also be implemented in programmable hardware devices such as field programmable gate arrays, programmable array logic, programmable logic devices, or the like.

Computer program code, i.e., instructions, for carrying out operations for aspects of the present disclosure may be written in any combination of one or more programming languages, including an object oriented programming language such as Java, Smalltalk, Python, C++, or the like, conventional procedural programming languages, such as the "C" programming language or similar programming languages, programming languages such as MATLAB or LabVIEW, or any of the machine learning software disclosed herein. The program code may execute entirely on the user's computer system, partly on the user's computer system, as a stand-alone software package, partly on the user's computer system (e.g., the computer system utilized for sorting) and partly on a remote computer system (e.g., the computer system utilized to train the machine learning system), or entirely on the remote computer system or server. In the latter scenario, the remote computer system may be connected to the user's computer system through any type of network, including a local area network ("LAN") or a wide area network ("WAN"), or the connection may be made to an external computer system (for example, through the Internet using an Internet Service Provider). As an example of the foregoing, various aspects of the present disclosure may be configured to execute on one or more of the computer system 107, automation control system 108, and the vision system 110.

These program instructions may also be stored in a computer readable storage medium that can direct a computer system, other programmable data processing apparatus, controller, or other devices to function in a particular manner, such that the instructions stored in the computer readable medium produce an article of manufacture including instructions which implement the function/act specified in the flowchart and/or block diagram block or blocks.

The program instructions may also be loaded onto a computer, other programmable data processing apparatus, controller, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

One or more databases may be included in a host for storing and providing access to data for the various implementations. One skilled in the art will also appreciate that, for security reasons, any databases, systems, or components of the present disclosure may include any combination of databases or components at a single location or at multiple locations, wherein each database or system may include any of various suitable security features, such as firewalls, access codes, encryption, de-encryption and the like. The database may be any type of database, such as relational, hierarchical, object-oriented, and/or the like. Common database products that may be used to implement the databases include DB2 by IBM, any of the database products available from Oracle Corporation, Microsoft Access by Microsoft Corporation, or any other database product. The database may be organized in any suitable manner, including as data tables or lookup tables.

Association of certain data (e.g., for each of the scrap pieces processed by a sorting system described herein) may be accomplished through any data association technique known and practiced in the art. For example, the association may be accomplished either manually or automatically. Automatic association techniques may include, for example, a database search, a database merge, GREP, AGREP, SQL, and/or the like. The association step may be accomplished by a database merge function, for example, using a key field in each of the manufacturer and retailer data tables. A key field partitions the database according to the high-level class of objects defined by the key field. For example, a certain class may be designated as a key field in both the first data table and the second data table, and the two data tables may then be merged on the basis of the class data in the key field. In these embodiments, the data corresponding to the key field in each of the merged data tables is preferably the same. However, data tables having similar, though not identical, data in the key fields may also be merged by using AGREP, for example.

Reference is made herein to "configuring" a device or a device "configured to" perform some function. It should be understood that this may include selecting predefined logic blocks and logically associating them, such that they provide particular logic functions, which includes monitoring or control functions. It may also include programming computer software-based logic of a retrofit control device, wiring discrete hardware components, or a combination of any or all of the foregoing. Such configured devises are physically designed to perform the specified function or functions.

In the descriptions herein, numerous specific details are provided, such as examples of programming, software modules, user selections, network transactions, database queries, database structures, hardware modules, hardware circuits, hardware chips, controllers, etc., to provide a thorough understanding of embodiments of the disclosure. One skilled in the relevant art will recognize, however, that the disclosure may be practiced without one or more of the specific details, or with other methods, components, materials, and so forth. In other instances, well-known structures, materials, or operations may be not shown or described in detail to avoid obscuring aspects of the disclosure.

Figure 14:
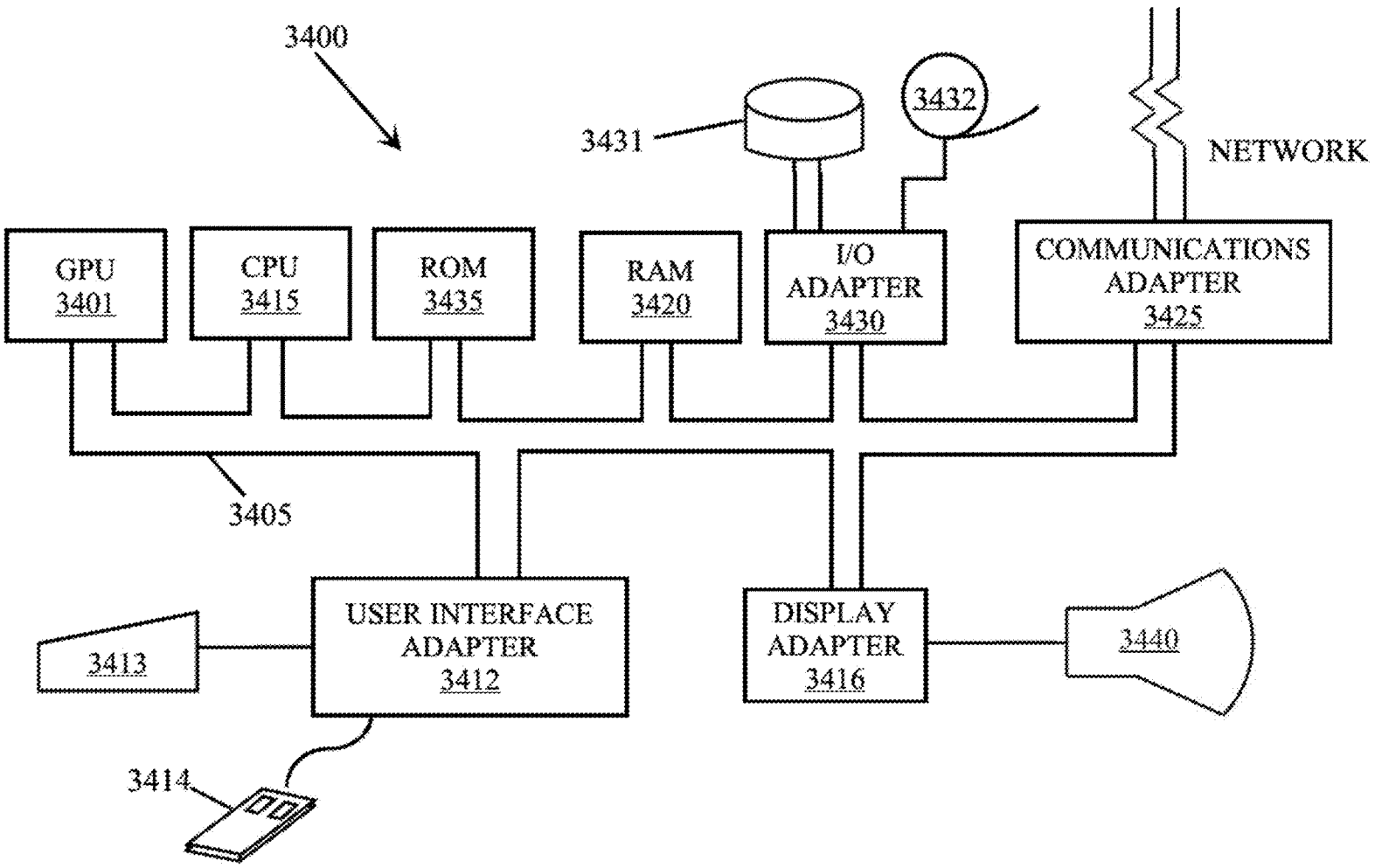
FIG. 14 illustrates a block diagram of a data processing system configured in accordance with embodiments of the present disclosure.

With reference now to FIG. 14, a block diagram illustrating a data processing ("computer") system 3400 is depicted in which aspects of embodiments of the disclosure may be implemented. (The terms "computer," "system," "computer system," and "data processing system" may be used interchangeably herein.) The computer system 107, the automation control system 108, and/or the vision system 110 may be configured similarly as the computer system 3400. The computer system 3400 may employ a local bus 3405 (e.g., a peripheral component interconnect ("PCI") local bus architecture). Any suitable bus architecture may be utilized such as Accelerated Graphics Port ("AGP") and Industry Standard Architecture ("ISA"), among others. One or more processors 3415, volatile memory 3420, and non-volatile memory 3435 may be connected to the local bus 3405 (e.g., through a PCI Bridge (not shown)). An integrated memory controller and cache memory may be coupled to the one or more processors 3415. The one or more processors 3415 may include one or more central processor units and/or one or more graphics processor units and/or one or more tensor processing units. Additional connections to the local bus 3405 may be made through direct component interconnection or through add-in boards. In the depicted example, a communication (e.g., network (LAN)) adapter 3425, an I/O (e.g., small computer system interface ("SCSI") host bus) adapter 3430, and expansion bus interface (not shown) may be connected to the local bus 3405 by direct component connection. An audio adapter (not shown), a graphics adapter (not shown), and display adapter 3416 (coupled to a display 3440) may be connected to the local bus 3405 (e.g., by add-in boards inserted into expansion slots).

The user interface adapter 3412 may provide a connection for a keyboard 3413 and a mouse 3414, modem (not shown), and additional memory (not shown). The I/O adapter 3430 may provide a connection for a hard disk drive 3431, a tape drive 3432, and a CD-ROM drive (not shown).

An operating system may be run on the one or more processors 3415 and used to coordinate and provide control of various components within the computer system 3400. In FIG. 14, the operating system may be a commercially available operating system. An object-oriented programming system (e.g., Java, Python, etc.) may run in conjunction with the operating system and provide calls to the operating system from programs or programs (e.g., Java, Python, etc.) executing on the system 3400. Instructions for the operating system, the object-oriented operating system, and programs may be located on non-volatile memory 3435 storage devices, such as a hard disk drive 3431, and may be loaded into volatile memory 3420 for execution by the processor 3415.

Those of ordinary skill in the art will appreciate that the hardware in FIG. 14 may vary depending on the implementation. Other internal hardware or peripheral devices, such as flash ROM (or equivalent nonvolatile memory) or optical disk drives and the like, may be used in addition to or in place of the hardware depicted in FIG. 14. Also, any of the processes of the present disclosure may be applied to a multiprocessor computer system, or performed by a plurality of such systems 3400. For example, training of the vision system 110 may be performed by a first computer system 3400, while operation of the vision system 110 for sorting may be performed by a second computer system 3400.

As another example, the computer system 3400 may be a stand-alone system configured to be bootable without relying on some type of network communication interface, whether or not the computer system 3400 includes some type of network communication interface. As a further example, the computer system 3400 may be an embedded controller, which is configured with ROM and/or flash ROM providing non-volatile memory storing operating system files or user-generated data.

The depicted example in FIG. 14 and above-described examples are not meant to imply architectural limitations. Further, a computer program form of aspects of the present disclosure may reside on any computer readable storage medium (i.e., floppy disk, compact disk, hard disk, tape, ROM, RAM, etc.) used by a computer system.

Figure 15A:
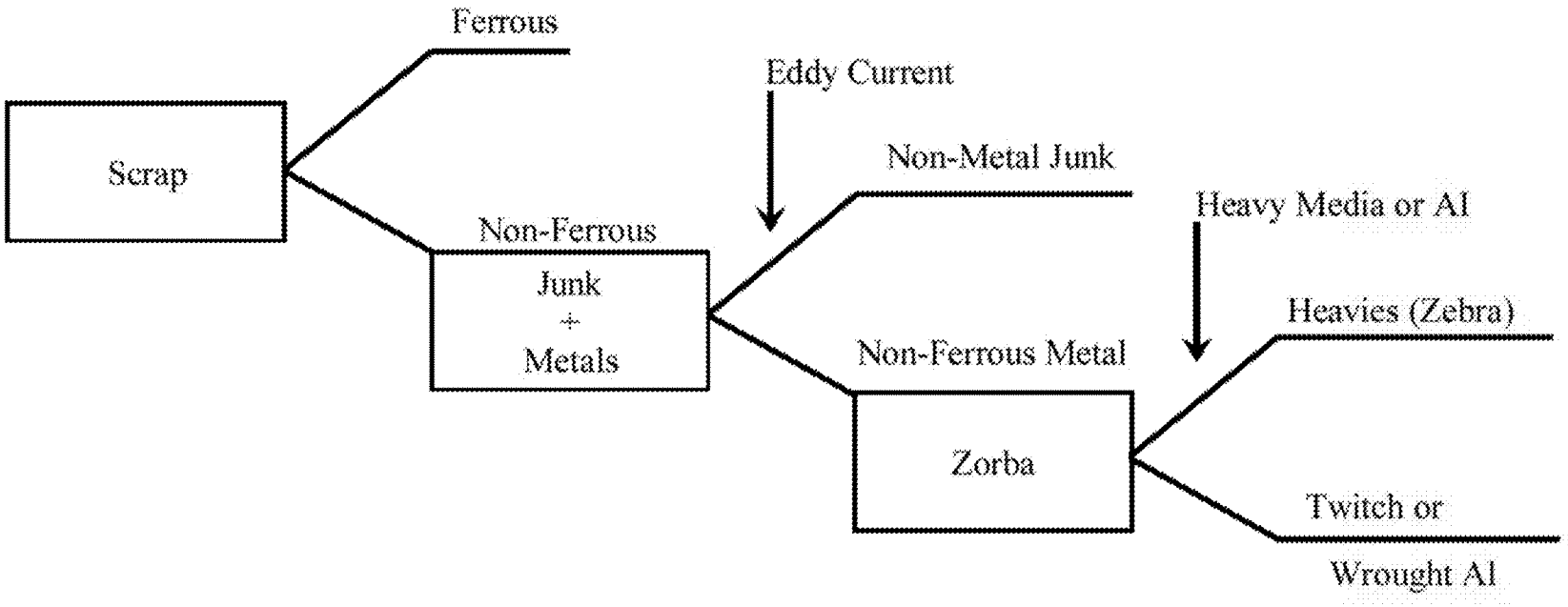
FIGS. 15A, 15B and 15C illustrate systems and processes for sorting materials for recycling.
Figure 15B:
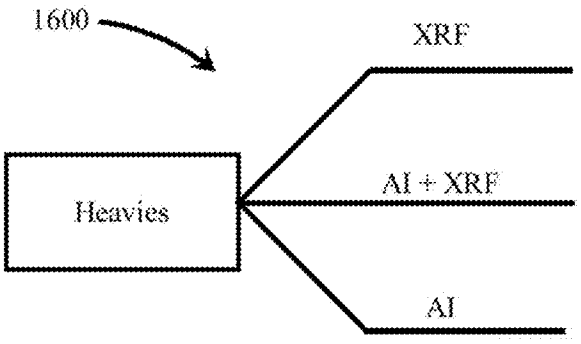
Figure 15C:
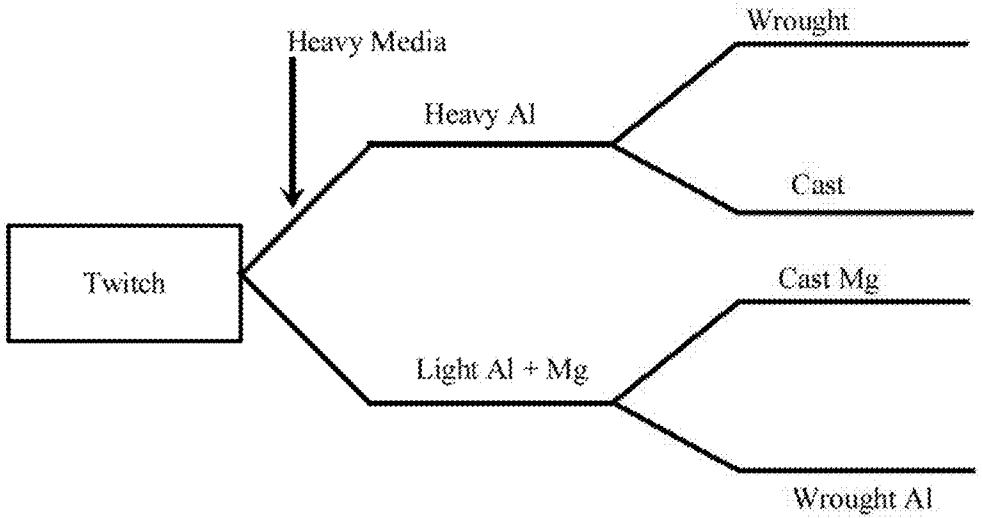

Referring to FIGS. 15A-15C, there is illustrated systems and processes configured in accordance with certain embodiments of the present disclosure in which materials (e.g., scrap) may be sorted for recycling. Referring to FIG. 15A, scrap, which may have been shredded, may be sorted between ferrous and non-ferrous materials. For example, a magnet may be utilized to remove the ferrous scrap pieces. The remaining non-ferrous materials may typically include non-ferrous metals (often referred to as Zorba) and other "junk" materials (e.g., cloth, leather, foam rubber, rubber, plastics, wood, PCBs, glass, etc.).

The Zorba may then be separated from the junk materials, for example, by utilization of a well-known eddy current method. The Zorba may include one or more of various metals (e.g., copper, brass, zinc, stainless steel, aluminum (cast and/or wrought), lead, high-Z cast aluminum alloys (e.g., cast aluminum alloys 319 and 380), low-Z cast aluminum alloys (e.g., cast aluminum alloys 356 and 360), nickel alloys, and gold or silver (e.g., located within PCBs).

The Zorba may be sorted between heavier and lighter metals. This may be accomplished utilizing various separating or sorting technologies. For example, a heavy media (e.g., water made selectively dense with sand) may be utilized to separate the heavy metals (also referred to as Zebra or "Heavies") from the lighter metals (e.g., Twitch).

Alternatively, a machine learning system configured in accordance with embodiments of the present disclosure may be utilized to sort the Zorba into the separate groups of Zebra and Twitch. Furthermore, certain embodiments of the present disclosure may be configured to sort out PCBs and/or "meatballs" and airbag canisters from ferrous scrap streams.

In another alternative embodiment, such a machine learning system may be utilized to sort out wrought aluminum from the Zorba. Applicants have discovered that typical Zorba (e.g., from shredded vehicles) can contain about 20% by weight and 50%-60% by volume of wrought aluminum. The wrought aluminum may be sorted out from the Zorba utilizing such a machine learning system (which has been trained to recognize wrought aluminum scrap pieces) at a relatively very high throughput rate (e.g., the conveyor belt operating at 350-500 feet per minute), which can reduce the number of scrap pieces in the lot by almost 60% before proceeding to a next sorting step.

Figure 16A:
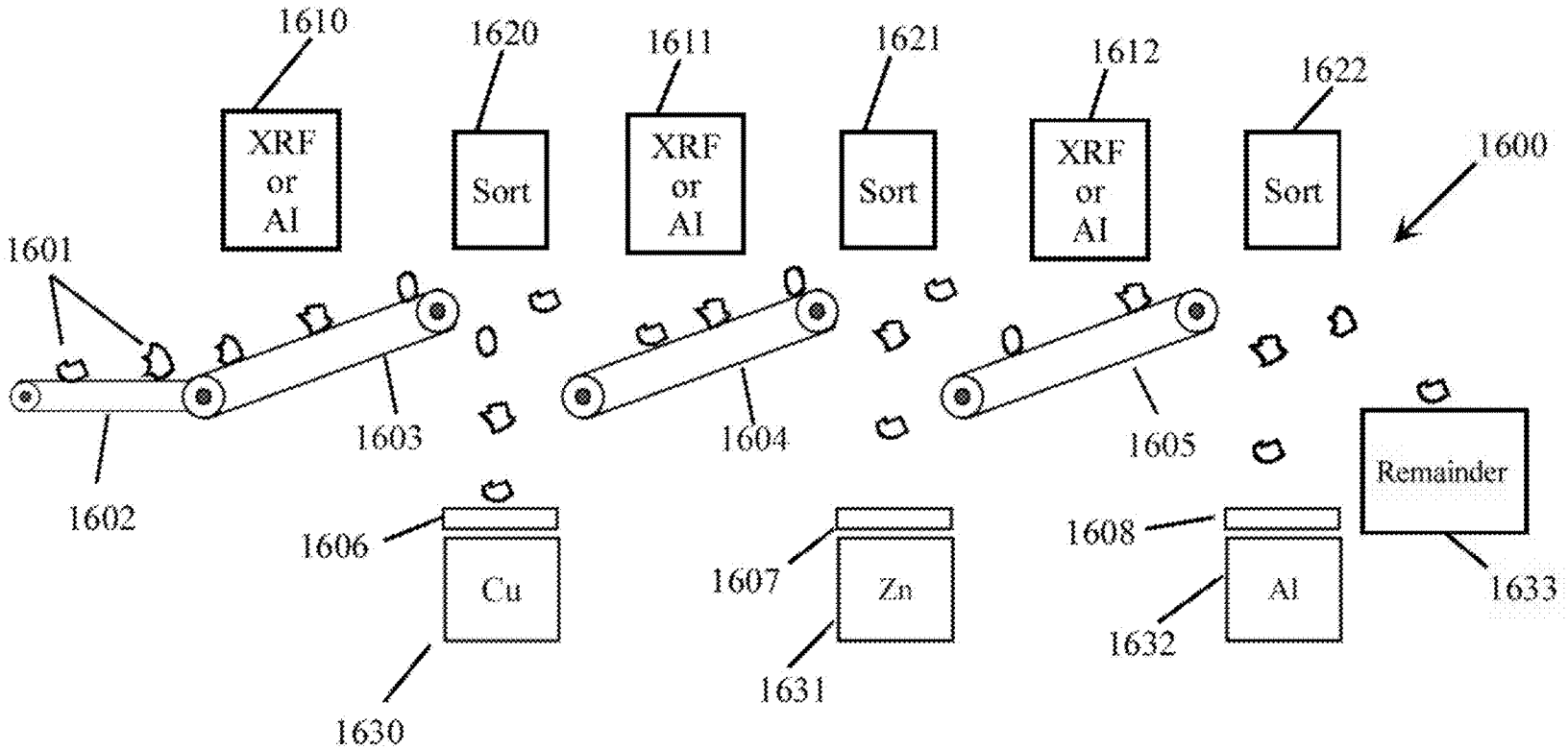
FIGS. 16A-16B illustrate systems and processes for sorting of heavy metals in accordance with certain embodiments of the present disclosure.
Figure 16B:
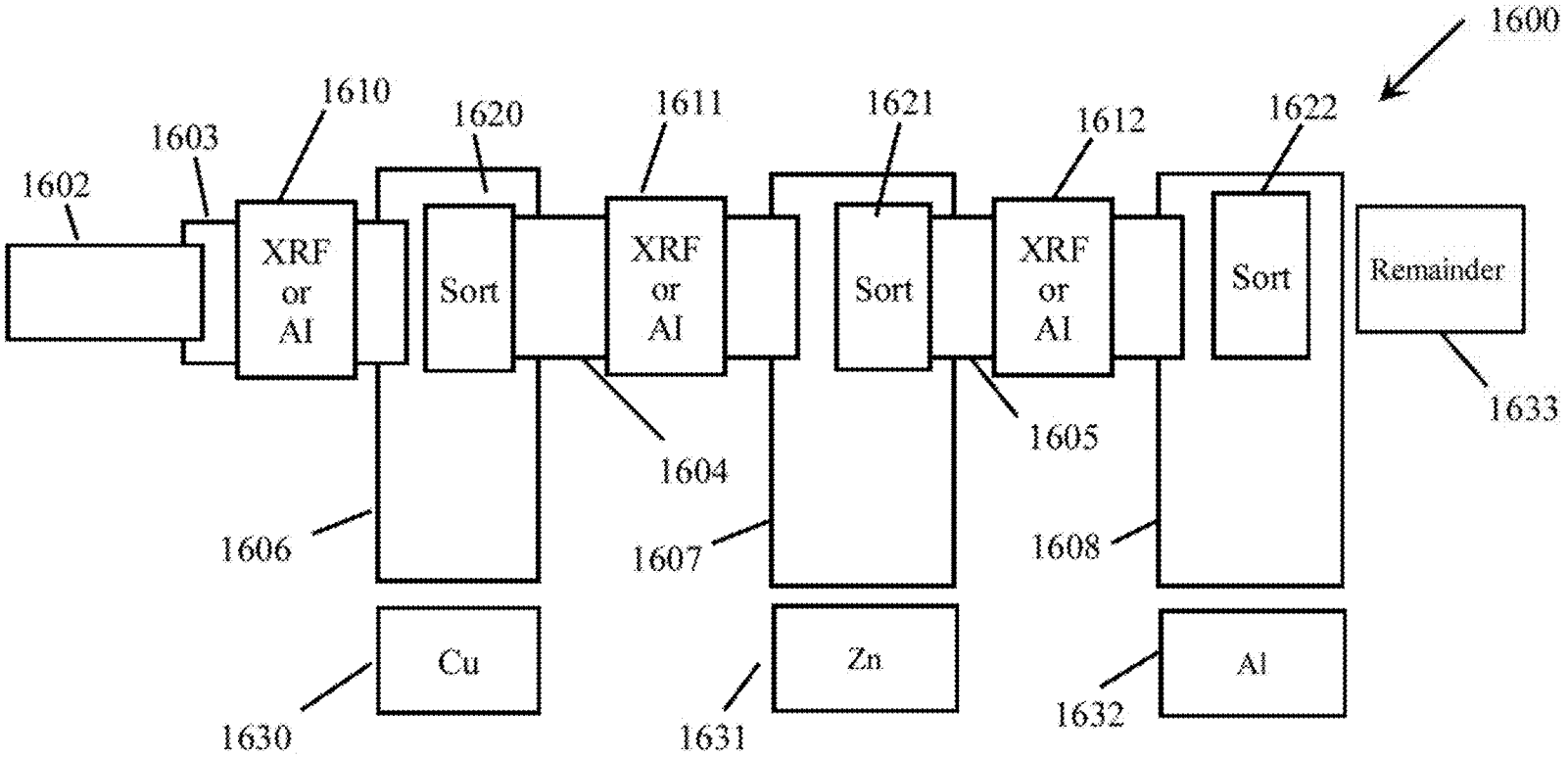

Whether Twitch or just wrought aluminum is separated/sorted out from the Zorba, a next process may be performed to sort various metals from the Zebra. As shown in FIG. 15B, this may be performed using a machine learning system (e.g., utilizing artificial intelligence), an x-ray fluorescence ("XRF") system utilized within a sorting system (such as disclosed in U.S. Pat. No. 10,207,296, which is hereby incorporate by reference herein), or a combination of a machine learning system and an XRF system (e.g., by first sorting with the machine learning system and then with the XRF system). The Zebra may be sorted to separately extract various metals (e.g., copper zinc, brass, etc.). FIGS. 16A-16B illustrate a system and process 1600 configured in accordance with certain embodiments of the present disclosure in order to sort the Zebra such as described with respect to FIG. 15B. FIG. 16A illustrates an exemplary non-limiting schematic diagram of a side view of such a system and process 1600, while FIG. 16B illustrates a top view.

Zebra scrap pieces 1601 may be conveyed (e.g., by a conveyor belt 1602) to be picked up by an inclined conveyor system 1603. Note that the scrap pieces 1601 are not depicted in FIG. 16B for the sake of simplicity. The conveyor system 1603 conveys the scrap pieces 1601 by an XRF or AI system 1610 in order to classify the scrap pieces for sorting.

In a non-limiting example, the XRF or AI system 1610 may be configured to recognize and classify those scrap pieces composed of a threshold amount of copper. The conveyor system 1603 may be configured to operate at a sufficient speed in order to "throw" the scrap pieces not classified as copper onto a following inclined conveyor system 1604. Scrap pieces classified as composed of a threshold amount of copper are ejected by a sorting device 1620 onto a lower positioned conveyor system 1606. For example, such a sorting device 1620 may be an air jet nozzle such as described herein, which is actuated to eject a scrap piece classified as copper from the normal trajectory of scrap pieces being "thrown" from the end of the conveyor system 1603 onto the conveyor system 1604. The classified scrap pieces may be conveyed into a bin or receptacle 1630.

The scrap pieces not classified as copper may be conveyed past an XRF or AI system 1611, which may be configured to identify and classify those scrap pieces that contain a threshold amount of another material (e.g., a metal such as zinc, aluminum, brass, stainless steel, gold, silver, etc.). The conveyor system 1604 may be configured to operate at a sufficient speed in order to "throw" the scrap pieces not classified as this other material onto a following inclined conveyor system 1605. Scrap pieces classified as composed of a threshold amount of another material (e.g., a metal such as zinc, aluminum, brass, stainless steel, gold, silver, etc.) may be ejected by a sorting device 1621 onto a lower positioned conveyor system 1607. For example, such a sorting device 1621 may be an air jet nozzle such as described herein, which is actuated to eject a scrap piece classified as zinc from the normal trajectory of scrap pieces being "thrown" from the end of the conveyor system 1604 onto the conveyor system 1605. The classified scrap pieces may be conveyed into a bin or receptacle 1631.

The scrap pieces not classified as zinc, for example, may be conveyed past an XRF or AI system 1612, which may be configured to identify and classify those scrap pieces that contain a threshold amount of another material (e.g., a metal such as zinc, aluminum, brass, stainless steel, gold, silver, etc.). The conveyor system 1605 may be configured to operate at a sufficient speed in order to "throw" the scrap pieces not classified as this other material onto yet another conveyor system (not shown) or into a bin or receptacle 1633 designated for the remainder of the scrap pieces not previously classified and sorted. For example, scrap pieces classified as composed of a threshold amount of another material (e.g., a metal such as zinc, aluminum, brass, stainless steel, gold, silver, etc.) may be ejected by a sorting device 1622 onto a lower positioned conveyor system 1608. For example, such a sorting device 1622 may be an air jet nozzle such as described herein, which is actuated to eject a scrap piece classified as aluminum, for example, from the normal trajectory of scrap pieces being "thrown" from the end of the conveyor system 1605. The classified scrap pieces may be conveyed into a bin or receptacle 1632.

Note that the system and process 1600 is not limited to one line of conveyor systems, but may be expanded to multiple lines each ejecting classified scrap pieces onto multiple conveyor systems (e.g., conveyor systems 1606 . . . 1608). Likewise, one or more of the conveyor systems 1606 . . . 1608 may be implemented with an additional XRF or AI system to further classify those scrap pieces.

Advantages of sorting Heavies are that brass can be recycled for making brass utensils and fittings, zinc can be recycled for making zinc castings, and copper can be recycled for making copper wires and pipes, etc.

Returning to FIG. 15C, the Twitch can be separated into heavy aluminum and lighter aluminum plus magnesium scrap pieces, for example, by utilizing a heavy media (e.g., made selectively dense with aluminum oxide). Note that since magnesium (e.g., cast magnesium) is less dense (thus lighter) than other metals, the Twitch may include scrap pieces composed of cast magnesium, such as for example, from electric lawn mower engines and electric power drills. Since magnesium is less dense than aluminum, a certain density of heavy media will float cast magnesium and sink cast aluminum. A problem is that wrought aluminum and foam aluminum may also float with the cast magnesium, since these forms of aluminum may have trapped air in pockets, which can result in too much magnesium with sorted wrought aluminum. However, since the wrought aluminum and magnesium have different appearances, a machine learning system as disclosed herein can be trained to sort between the materials.

As shown in FIG. 15C, the light aluminum can be separated from the magnesium. Additionally, the heavy aluminum scrap pieces may be run through an AI sorter as described herein to separate cast aluminum from wrought aluminum within that grouping.

Furthermore, various cast aluminum alloys can be sorted by an XRF system as described herein. For example, cast aluminum alloy 319 has a single large copper peak observable in its XRF spectrum, cast aluminum alloy 356 does not have such a large copper peak, and cast aluminum alloy 380 has both large copper and zinc peaks. These large differences can be utilized by an XRF system to sort between these cast aluminum alloys with high accuracy.

Therefore, in accordance with certain embodiments of the present disclosure, a sorting system and process can first sort out wrought aluminum scrap pieces, then the remaining scrap pieces can be run through a sorting system implementing an XRF system to sort between various cast aluminum alloys.

Reference throughout this specification to "an embodiment," "embodiments," or similar language means that a particular feature, structure, or characteristic described in connection with the embodiments is included in at least one embodiment of the present disclosure. Thus, appearances of the phrases "in one embodiment," "in an embodiment," "embodiments," "certain embodiments," "various embodiments," and similar language throughout this specification may, but do not necessarily, all refer to the same embodiment. Furthermore, the described features, structures, aspects, and/or characteristics of the disclosure may be combined in any suitable manner in one or more embodiments. Correspondingly, even if features may be initially claimed as acting in certain combinations, one or more features from a claimed combination can in some cases be excised from the combination, and the claimed combination can be directed to a sub-combination or variation of a sub-combination.

Benefits, advantages, and solutions to problems have been described above with regard to specific embodiments. However, the benefits, advantages, solutions to problems, and any element(s) that may cause any benefit, advantage, or solution to occur or become more pronounced may be not to be construed as critical, required, or essential features or elements of any or all the claims. Further, no component described herein is required for the practice of the disclosure unless expressly described as essential or critical.

Those skilled in the art having read this disclosure will recognize that changes and modifications may be made to the embodiments without departing from the scope of the present disclosure. It should be appreciated that the particular implementations shown and described herein may be illustrative of the disclosure and its best mode and may be not intended to otherwise limit the scope of the present disclosure in any way. Other variations may be within the scope of the following claims.

While this specification contains many specifics, these should not be construed as limitations on the scope of the disclosure or of what can be claimed, but rather as descriptions of features specific to particular implementations of the disclosure. Headings herein may be not intended to limit the disclosure, embodiments of the disclosure or other matter disclosed under the headings.

Herein, the term "or" may be intended to be inclusive, wherein "A or B" includes A or B and also includes both A and B. As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

The terminology used herein is for the purpose of describing particular embodiments only and is not intended to be limiting of the disclosure. As used herein, the singular forms "a," "an," and "the" may be intended to include the plural forms as well, unless the context clearly indicates otherwise.

The corresponding structures, materials, acts, and equivalents of all means or step plus function elements in the claims below may be intended to include any structure, material, or act for performing the function in combination with other claimed elements as specifically claimed.

As used herein with respect to an identified property or circumstance, "substantially" refers to a degree of deviation that is sufficiently small so as to not measurably detract from the identified property or circumstance. The exact degree of deviation allowable may in some cases depend on the specific context. As used herein, "significance" or "significant" relates to a statistical analysis of the probability that there is a non-random association between two or more entities. To determine whether or not a relationship is "significant" or has "significance," statistical manipulations of the data can be performed to calculate a probability, expressed as a "p value." Those p values that fall below a user-defined cutoff point are regarded as significant. In some embodiments, a p value less than or equal to 0.05, in some embodiments less than 0.01, in some embodiments less than 0.005, and in some embodiments less than 0.001, are regarded as significant. Accordingly, a p value greater than or equal to 0.05 is considered not significant.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a defacto equivalent of any other member of the same list solely based on their presentation in a common group without indications to the contrary.

Unless defined otherwise, all technical and scientific terms (such as acronyms used for chemical elements within the periodic table) used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are now described.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that can vary depending upon the desired properties sought to be obtained by the presently disclosed subject matter. As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

What is claimed is:

1. A system for classifying and sorting a first mixture of materials comprising extruded aluminum scrap pieces and cast aluminum scrap pieces, the system comprising:

an image capturing device configured to produce image data of the first mixture of materials comprising extruded aluminum scrap pieces and cast aluminum scrap pieces;

a conveyor system configured to convey the first mixture past the image capturing device;

a data processing system comprising a machine learning system configured with a first knowledge base to classify certain ones of the first mixture as extruded aluminum scrap pieces by processing the image data of the first mixture through the machine learning system, wherein the first knowledge base contains a previously generated library of observed characteristics pertaining to aluminum scrap pieces; and a sorter configured to sort the classified certain ones of the first mixture from the first mixture as a function of the classifying of certain ones of the first mixture.

2. The system as recited in claim 1, wherein the previously generated library of observed characteristics was captured by a camera configured to capture images of a homogenous set of samples of the extruded aluminum scrap pieces as they were conveyed past the camera.

3. The system as recited in claim 1, wherein the image capturing device is a camera configured to capture visual images of the first mixture of materials comprising extruded aluminum scrap pieces and cast aluminum scrap pieces to produce the image data, and wherein the observed characteristics are visually observed characteristics.

4. The system as recited in claim 1, wherein the sorting by the sorter of the classified certain ones of the first mixture from the first mixture produces a second mixture of materials that comprises the first mixture minus the classified certain ones of the first mixture, wherein the second mixture of materials has an aggregate chemical composition appropriate for manufacturing cast aluminum parts.

5. The system as recited in claim 1, wherein the machine learning system comprises an artificial intelligence neural network.

6. The system as recited in claim 1, wherein the classifying of certain ones of the first mixture is based on a comparison of the first knowledge base to a second knowledge base containing a previously generated library of observed characteristics captured from a homogenous set of samples of cast aluminum scrap pieces.

7. The system as recited in claim 1, wherein the system is configured to sort the extruded aluminum scrap pieces from the cast aluminum scrap pieces based on the classifying of certain ones of the first mixture as extruded aluminum scrap pieces.

8. The system as recited in claim 1, wherein the machine learning system has been previously trained, as represented within the first knowledge base, to distinguish between captured images of extruded aluminum scrap pieces and captured images of cast aluminum scrap pieces.

9. A method for classifying and sorting a first mixture of materials comprising extruded aluminum scrap pieces and cast aluminum scrap pieces, the method comprising:

producing image data of the first mixture of materials comprising extruded aluminum scrap pieces and cast aluminum scrap pieces;

processing the image data through a machine learning system configured with a first knowledge base containing a previously generated library of observed characteristics pertaining to extruded aluminum scrap pieces;

assigning with the machine learning system a first classification to certain ones of the first mixture of materials as extruded aluminum scrap pieces as a function of the processing of the image data of the first mixture; and sorting the certain ones of the first mixture of materials from the first mixture as a function of the first classification.

10. The method as recited in claim 9, further comprising conveying the first mixture of materials past an image capturing device configured to produce the image data.

11. The method as recited in claim 10, wherein the image capturing device is a camera configured to capture visual images of the first mixture of materials to produce the image data, and wherein the observed characteristics are visually observed characteristics.

12. The method as recited in claim 9, wherein the previously generated library of observed characteristics was captured by a camera configured to capture images of a homogenous set of samples of the extruded aluminum scrap pieces as they were conveyed past the camera.

13. The method as recited in claim 9, wherein the sorting produces a second mixture of materials that comprises the first mixture of materials minus the sorted certain ones of the first mixture of materials, the method further comprising melting the second mixture to produce a metal composition appropriate for manufacturing into cast aluminum parts.

14. The method as recited in claim 9, wherein the machine learning system comprises an artificial intelligence neural network.

15. The method as recited in claim 9, wherein the machine learning system has been previously trained, as represented within the first knowledge base, to distinguish between captured images of extruded aluminum scrap pieces and captured images of cast aluminum scrap pieces.

16. A computer program product stored on a computer readable storage medium, which when executed by a data processing system, performs a process for classifying materials, comprising:

receiving visual image data of each piece of a collection of materials comprising pieces that are extruded and/or wrought aluminum scrap pieces and pieces that are cast aluminum scrap pieces;

classifying certain pieces of the collection of materials as extruded and/or wrought aluminum scrap pieces as a function of visual characteristics captured from the visual image data, wherein the visual characteristics are unique to extruded and/or wrought aluminum scrap pieces; and classifying a remainder of the pieces of the collection of materials as cast aluminum scrap pieces, wherein the computer program product comprises a machine learning system implementing one or more machine learning algorithms configured to classify the collection of materials, wherein the one or more machine learning algorithms have been previously trained to recognize the visual characteristics unique to extruded and/or wrought aluminum scrap pieces.

17. The computer program product as recited in claim 16, wherein the computer readable storage medium, which when executed, comprises sending to an automated sorting device information regarding the classifications used by the automated sorting device to sort the certain pieces classified as extruded and/or wrought aluminum scrap pieces from the remainder of pieces classified as cast aluminum scrap pieces.

18. The computer program product as recited in claim 16, wherein the one or more machine learning algorithms are configured to perform the classifying of the collection of materials as a function of a knowledge base of parameters configured during a training stage to recognize the visual characteristics unique to extruded and/or wrought aluminum scrap pieces, wherein the training stage comprises processing a control sample of a plurality of extruded and/or wrought aluminum scrap pieces in order to create the knowledge base.

* * * * *